US009396694B2

(12) United States Patent
Ahn et al.

(10) Patent No.: US 9,396,694 B2
(45) Date of Patent: Jul. 19, 2016

(54) DISPLAY DEVICE AND DRIVING METHOD THEREOF

(71) Applicant: Samsung Display Co., Ltd., Yongin, Gyeonggi-Do (KR)

(72) Inventors: Ik Hyun Ahn, Hwaseong-si (KR); Yoon Gu Kim, Seoul (KR); Bong Im Park, Asan-si (KR); Ho Seok Son, Anyang-si (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 21 days.

(21) Appl. No.: 14/332,889

(22) Filed: Jul. 16, 2014

(65) Prior Publication Data

US 2015/0194119 A1 Jul. 9, 2015

(30) Foreign Application Priority Data

Jan. 3, 2014 (KR) ..... 10-2014-0000748

(51) Int. Cl.

*G09G 3/36* (2006.01)
*G09G 3/32* (2016.01)
*G09G 3/20* (2006.01)

(52) U.S. Cl.

CPC ..... *G09G 3/3696* (2013.01); *G09G 3/2025* (2013.01); *G09G 3/3291* (2013.01); *G09G 3/3614* (2013.01); *G09G 3/3688* (2013.01); *G09G 2230/00* (2013.01); *G09G 2300/0426* (2013.01); *G09G 2300/0452* (2013.01); *G09G 2310/027* (2013.01); *G09G 2310/0248* (2013.01); *G09G 2310/0251* (2013.01); *G09G 2320/0285* (2013.01)

(58) Field of Classification Search

CPC ..... G09G 3/3648; G09G 3/3614; G09G 2310/0205; G09G 2300/0426

See application file for complete search history.

(56) References Cited

U.S. PATENT DOCUMENTS 7,095,393 B2 8/2006 Lee
7,468,716 B2 12/2008 Lee et al.

(Continued)

FOREIGN PATENT DOCUMENTS

KR 10-2008-0001179 A 1/2008
KR 10-2009-0066528 A 6/2009

(Continued)

*Primary Examiner* — Shaheda Abdin

(74) *Attorney, Agent, or Firm* — Knobbe, Martens, Olson & Bear, LLP

(57) ABSTRACT

A display device and a driving method thereof is disclosed. In one aspect, the display device includes: a display panel including a plurality of pixels, a plurality of gate lines arranged in a column direction, and a plurality of data lines intersecting the plurality of gate lines; a data driver transferring data voltages to the plurality of data lines; a gate driver transferring gate signals to the plurality of gate lines; and a signal controller controlling the data driver and the gate driver. The signal controller includes: a vertical boundary detector determining whether a first pixel among the plurality of pixels is positioned in the vicinity of a boundary region of an image pattern based on an input image signal for the first pixel; and a first adjuster adjusting an image signal of the first pixel based on an image signal of a second pixel positioned in a row previous to the first pixel and the image signal of the first pixel to output an adjusted image signal, in the case in which it is determined by the vertical boundary detector that the first pixel is positioned in the vicinity of the boundary region of the image pattern.

20 Claims, 18 Drawing Sheets

(56) References Cited

U.S. PATENT DOCUMENTS

| | | | | |
|---|---|---|---|---|
| 7,522,138 | B2 | 4/2009 | Lee et al. | |
| 2009/0285308 | A1* | 11/2009 | Panchapakesan | H04N 19/61 375/240.24 |
| 2012/0183231 | A1* | 7/2012 | Nagara | H04N 13/0048 382/232 |
| 2012/0249492 | A1 | 10/2012 | Kim et al. | |
| 2013/0271441 | A1 | 10/2013 | Ahn et al. | |
| 2014/0168281 | A1 | 6/2014 | Ahn et al. | |
| 2015/0022512 | A1 | 1/2015 | Ahn et al. | |
| 2015/0035866 | A1 | 2/2015 | Ahn et al. | |

FOREIGN PATENT DOCUMENTS

| | | | |
|---|---|---|---|
| KR | 10-2012-0134238 | A | 12/2012 |
| KR | 10-1274691 | B1 | 6/2013 |

* cited by examiner

DISPLAY DEVICE AND DRIVING METHOD THEREOF

CROSS-REFERENCE TO RELATED APPLICATIONS

This application claims priority under 35 U.S.C. §119 to Korean Patent Application No. 10-2014-0000748 filed in the Korean Intellectual Property Office on Jan. 3, 2014, the entire contents of which are incorporated herein by reference.

BACKGROUND

1. Field

The described technology generally relates to a display device and a driving method thereof.

2. Description of the Related Technology

A display device such as a liquid crystal display (LCD), an organic light emitting diode (OLED) display, or the like, generally includes a display panel and a driving device driving the display panel.

The display panel includes a plurality of signal lines and a plurality of pixels connected to the plurality of signal lines which are approximately arranged in a matrix form.

The signal lines include a plurality of gate lines transferring a gate signal Vg and a plurality of data lines transferring a data voltage.

Each pixel includes at least one switching element connected to a corresponding gate line and a corresponding data line. At least one pixel electrode is connected to the switching element. A counter electrode facing the pixel electrode receives a common voltage. The switching element includes at least one thin film transistor, and may be turned on or off depending on the gate signal transferred by the gate line to selectively transfer the data voltage transferred by the data line to the pixel electrode. Each pixel displays an image of corresponding luminance depending on the difference between the data voltage applied to the pixel electrode and a common voltage.

In some implementations of display devices, the image displayed by the display device is divided into a still image and a moving picture image. The display device displays the still image when image signals of neighboring frames are the same. The display device displays the moving picture image when the image signals of the neighboring frames are different.

In some implementations, the driving device includes a plurality of drivers and a signal controller controlling the drivers. The signal controller generates control signals for driving the display panel and transmits the control signals together with the image signals to the driver or the drivers. The driver includes a gate driver generating the gate signal and a data driver generating the data voltage.

The above information disclosed in this Background section is only for enhancement of understanding of the background of the invention and therefore it does not constitute admission of existence or relevancy of prior art.

SUMMARY OF CERTAIN INVENTIVE ASPECTS

As resolution of a display device is increased, an image having higher image quality may be provided. Therefore, recently, the resolution of the display device has been increasing. As the resolution is increased, a time in which each pixel is charged with the data voltage becomes shorter, such that a charging rate of each pixel is decreased, thereby making it possible to generate a spot due to charging. Particularly, in the case in which polarity of the data voltage is inverted, a time is insufficient to charge each pixel with a target data voltage, such that a charging rate of each pixel may be decreased. In addition, the number of frames displayed by the display device per second, that is, frame frequency has been increased, such that the charging rate of the pixel may be further decreased.

Accordingly, the disclosed technology has been made in an effort to provide a display device and a driving method thereof having advantages of preventing generation of a spot due to charging by compensating and improving a charging rate of the display device.

Further, the disclosed technology has been made in an effort to provide a display device and a driving method thereof having advantages of improving display quality by preventing a boundary region between image patterns from being blurred at the time of performing pre-charging.

An exemplary embodiment provides a display device including: a display panel including a plurality of pixels, a plurality of gate lines arranged in a column direction, and a plurality of data lines intersecting the plurality of gate lines; a data driver transferring data voltages to the plurality of data lines; a gate driver transferring gate signals to the plurality of gate lines; and a signal controller controlling the data driver and the gate driver. The signal controller includes: a vertical boundary detector determining whether a first pixel among the plurality of pixels is positioned in the vicinity of a boundary region of an image pattern based on an input image signal for the first pixel; and a first adjuster adjusting an image signal of the first pixel based on an image signal of a second pixel positioned in a row previous to the first pixel and the image signal of the first pixel to output an adjusted image signal, in the case in which it is determined by the vertical boundary detector that the first pixel is positioned in the vicinity of the boundary region of the image pattern.

The first adjuster may include a first lookup table storing a first adjusted value corresponding to the image signal of the first pixel and the image signal of the second pixel.

The gate signal may include a pre-charging period and a main-charging period in which a gate-on voltage is applied, the pre-charging period for the first pixel may be overlapped with the main-charging period for the second pixel, and the second pixel may be positioned previous to the first pixel by k rows, wherein k indicates a natural number.

The vertical boundary detector may determine that the first pixel is positioned in the vicinity of the boundary region of the image pattern in the case in which the first pixel is positioned below a boundary of the image pattern and is positioned below m rows, wherein m indicates a natural number of k or less, from the boundary of the image pattern.

The signal controller may further include an image signal realigner realigning image signals of a plurality of pixels including the first and second pixels to send the realigned image signals to the first adjuster.

The pixel may include first and second sub-pixels displaying an image depending on different gamma curves from each other, and the first lookup table may include a plurality of lookup tables storing the first adjusted values corresponding to an image signal for the first or second sub-pixel included in the first pixel and an image signal of the first or second sub-pixel included in the second pixel.

One data line may be alternately connected to the first and second sub-pixels by a unit of a pixel row along a column direction.

The signal controller may further include a second adjuster adjusting the input image signal for the first pixel to generate the image signals for the plurality of pixels and sending the generated image signals to the image signal realigner.

The second adjuster may include a plurality of second lookup tables each corresponding to different positions of the display panel, the second lookup table may store a second adjusted value of the input image signal for the first pixel, the second adjusted value being a value that depends on the input image signal for the first pixel and an input image signal for the second pixel, the second pixel may be charged with a data voltage of a first data line to which the first pixel is connected before the first pixel is charged, and the signal controller may adjust the input image signal for the first pixel using the second adjusted value.

The plurality of second lookup tables may include different lookup tables depending on a distance from the data driver.

The plurality of second lookup tables may include different lookup tables depending on a distance from the gate driver.

The second pixel may include a pixel positioned in a pixel row.

The second pixel may include a plurality of pixels positioned in different pixel rows from each other.

The pre-charging period and the main-charging period may be connected to each other.

Another embodiment provides a driving method of a display device including a display panel including a plurality of pixels, a plurality of gate lines arranged in a column direction, and a plurality of data lines intersecting a plurality of gate lines, a data driver connected to the plurality of data lines, a gate driver connected to the plurality of gate lines, and a signal controller controlling the data driver and the gate driver, including: determining whether a first pixel among the plurality of pixels is positioned in the vicinity of a boundary region of an image pattern based on an input image signal for the first pixel; and adjusting an image signal of the first pixel based on an image signal of a second pixel positioned in a row previous to the first pixel and the image signal of the first pixel to output an adjusted image signal, in the case in which it is determined that the first pixel is positioned in the vicinity of the boundary region of the image pattern.

In the adjusting of the image signal of the first pixel to output the adjusted image signal, a first lookup table storing a first adjusted value corresponding to the image signal of the first pixel and the image signal of the second pixel may be referenced.

The gate signal may include a pre-charging period and a main-charging period in which a gate-on voltage is applied, the pre-charging period for the first pixel may be overlapped with the main-charging period for the second pixel, and the second pixel may be positioned previous to the first pixel by k rows, wherein k indicates a natural number.

In the determining of whether the first pixel is positioned in the vicinity of the boundary region of the image pattern, it may be determined that the first pixel is positioned in the vicinity of the boundary region of the image pattern in the case in which the first pixel is positioned below a boundary of the image pattern and is positioned below m rows, wherein m indicates a natural number of k or less, from the boundary of the image pattern.

The driving method of a display device may further include realigning image signals of a plurality of pixels including the first and second pixels before the adjusting of the image signal of the first pixel to output the adjusted image signal.

The driving method of a display device may further include adjusting the input image signal for the first pixel to generate the image signals for the plurality of pixels before the realigning of the image signals of the plurality of pixels including the first and second pixels.

According to an exemplary embodiment, it is possible to prevent generation of a spot due to charging by compensating and improving a charging rate of the display device. In addition, it is possible to improve display quality by preventing a boundary region between image patterns from being blurred at the time of performing pre-charging.

DETAILED DESCRIPTION OF CERTAIN INVENTIVE EMBODIMENTS

First, a display device according to an exemplary embodiment will be described with reference to FIGS. 1 to 6.

Figure 1:
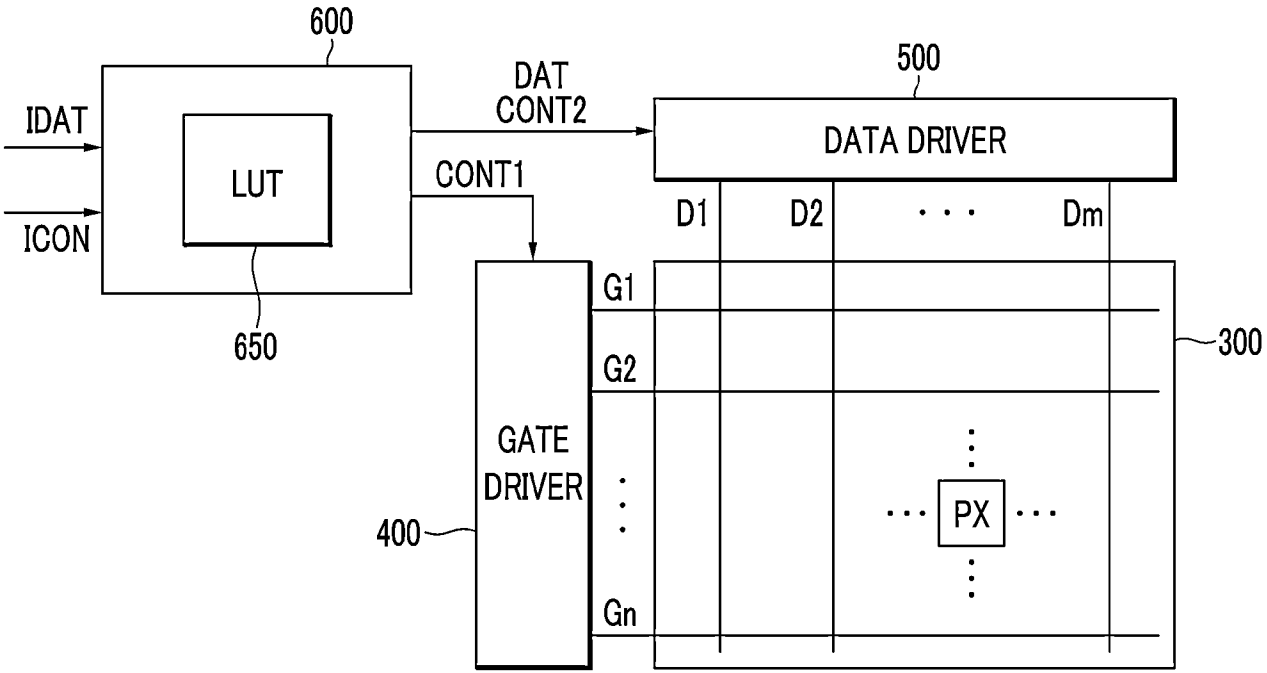
FIG. 1 is a block diagram of a display device according to an exemplary embodiment.
Figure 2:
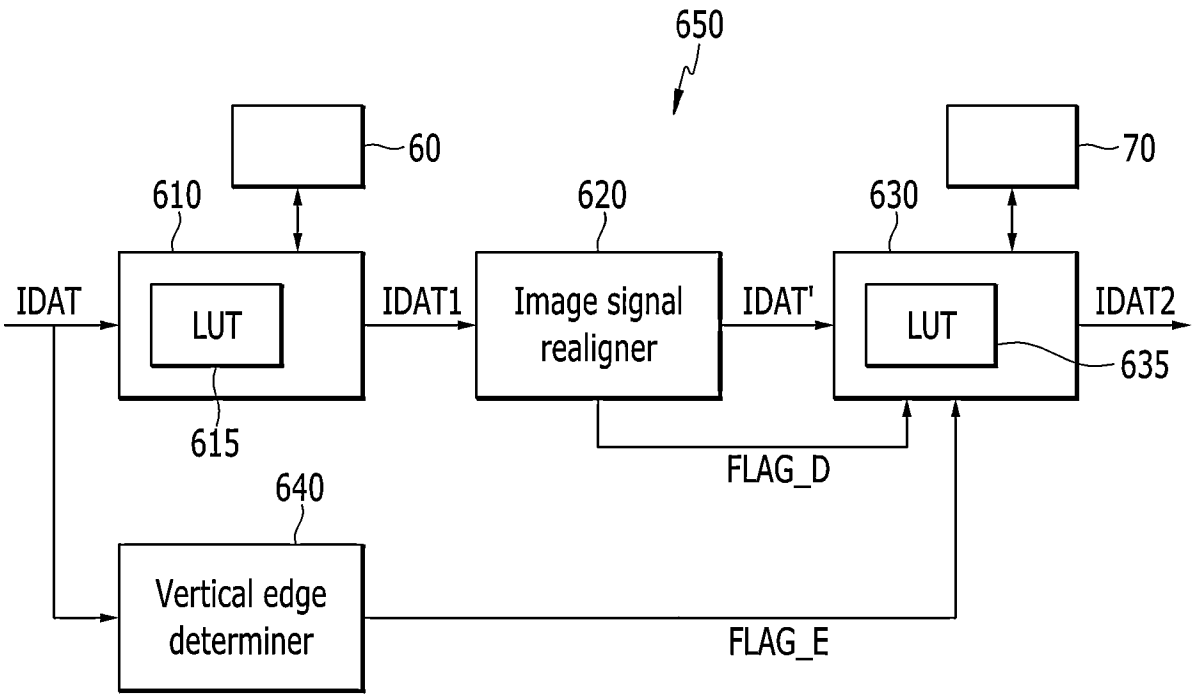
FIG. 2 is a block diagram of a signal adjusting unit of the display device according to an exemplary embodiment.
Figure 3:
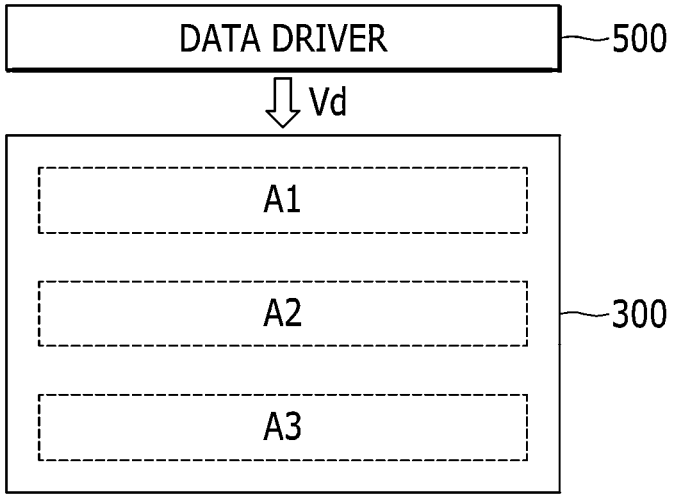
FIG. 3 is a block diagram of a display panel and a data driver of the display device according to an exemplary embodiment.
Figure 4:
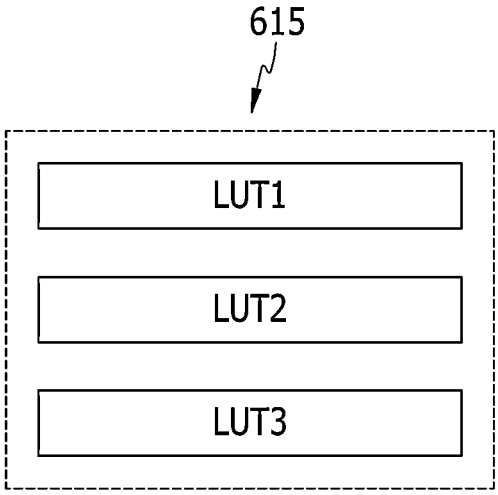
FIG. 4 is a block diagram of a first lookup table included in the signal adjusting unit of the display device according to an exemplary embodiment.
Figure 5:
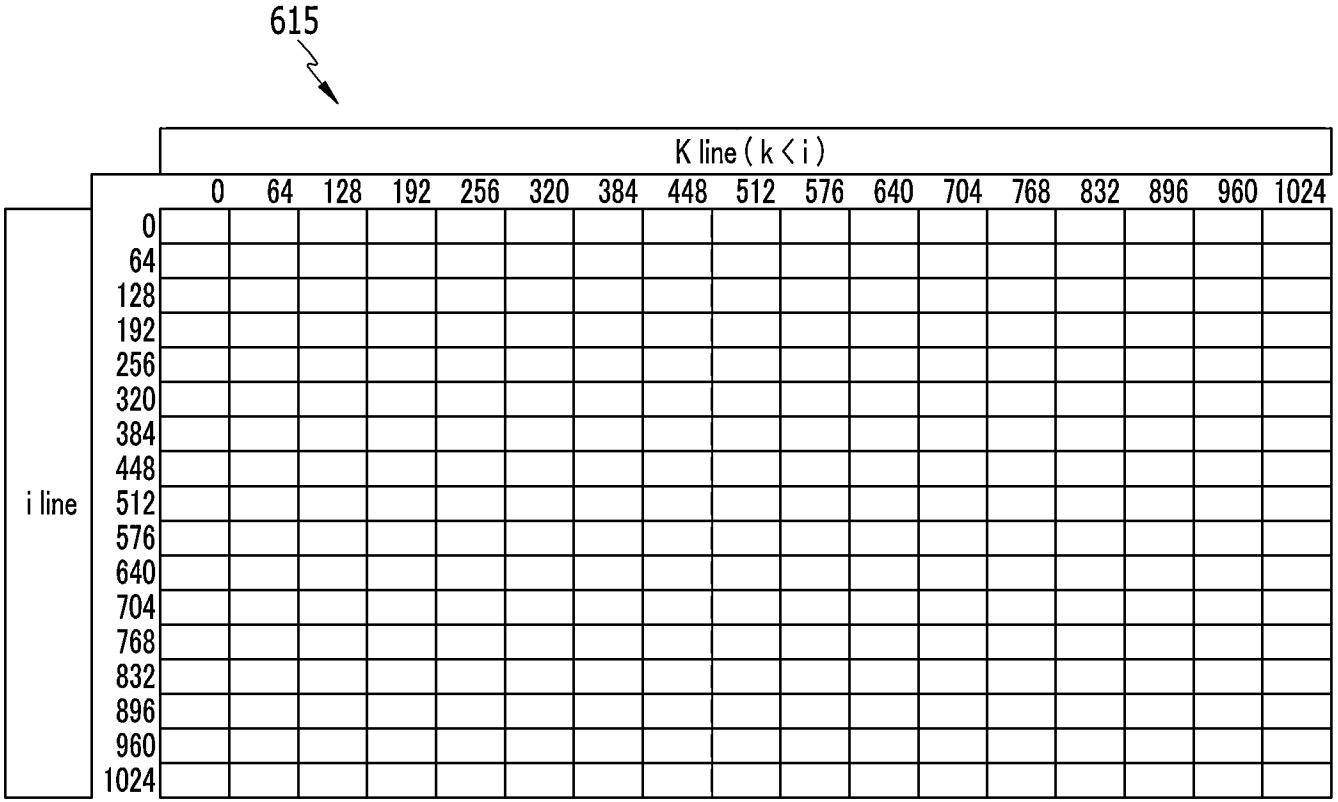
FIG. 5 is a diagram showing an example of the first lookup table included in the signal adjusting unit of the display device according to an exemplary embodiment.
Figure 6:
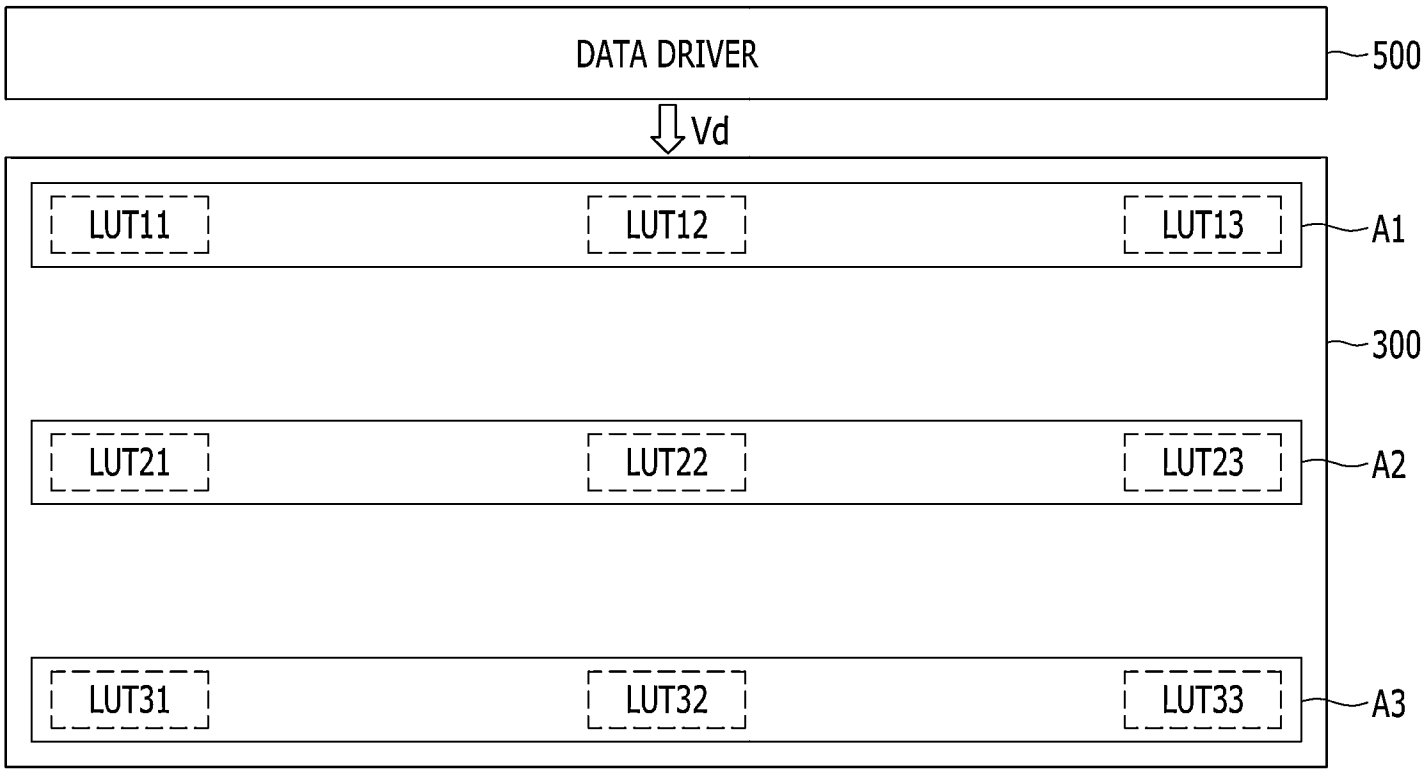
FIG. 6 is a block diagram of the display panel and the data driver of the display device according to an exemplary embodiment.

FIG. 1 is a block diagram of a display device according to an exemplary embodiment. FIG. 2 is a block diagram of a signal adjusting unit of the display device according to an exemplary embodiment. FIG. 3 is a block diagram of a display panel and a data driver of the display device according to an exemplary embodiment, FIG. 4 is a block diagram of a first lookup table included in the signal adjusting unit of the display device according to an exemplary embodiment, FIG. 5 is a diagram showing an example of the first lookup table included in the signal adjusting unit of the display device according to an exemplary embodiment, and FIG. 6 is a block diagram of the display panel and the data driver of the display device according to an exemplary embodiment.

Referring to FIG. 1, the display device according to an exemplary embodiment is configured to include a display panel 300, a gate driver 400, a data driver 500, and a signal controller 600 controlling the data driver 500 and the gate driver 400.

The display panel 300 may be a display panel included in various flat panel displays (FPDs) such as a liquid crystal display (LCD), an organic light emitting diode (OLED) display, an electrowetting display (EWD), and the like.

The display panel 300 includes a plurality of gate lines G1 to Gn, a plurality of data lines D1 to Dm, and a plurality of pixels PX connected to the plurality of gate lines G1 to Gn and the plurality of data lines D1 to Dm.

The gate lines G1 to Gn may transfer gate signals, be approximately extended in a row direction, and be substantially parallel with each other. The data lines D1 to Dm may transfer data voltages, be approximately extended in a column direction, and be substantially in parallel with each other.

The plurality of pixels PX may be approximately arranged in a matrix form. Each pixel PX may include at least one switching element connected to corresponding gate lines G1 to Gn and corresponding data lines D1 to Dm, and at least one pixel electrode connected to the switching element. The switching element may include at least one thin film transistor which may be turned on or turned off based on the gate signals transferred to it by the gate lines G1 to Gn. The switching element then may selectively transfer the data voltages transferred to it by the data lines D1 to Dm to the pixel electrode. Each pixel PX may display an image of corresponding luminance depending on the data voltage applied to the pixel electrode.

Each pixel PX displays one of the primary colors (spatial division) or alternately displays the primary colors over time (time division). In order to implement a color display, the desired colors may be achieved by the spatial or temporal summing of these primary colors. An example of the primary colors may include three primary colors such as red, green, blue, and the like. A plurality of adjacent pixels PX displaying different primary colors may form one set (referred to as a dot) together. One dot may display a white image.

The gate driver 400 receives gate control signals CONT1 from the signal controller 600 and generates the gate signals of a gate-on voltage Von capable of turning on the switching elements of the pixels PX. The gate driver 400 can also generate a gate-off voltage Voff capable of turning off the switching elements of the pixels PX based on the gate control signals. The gate control signal CONT1 includes a scanning start signal STV instructing scanning to be started, at least one gate clock signal CPV controlling an output timing of the gate-on voltage Von, and the like. The gate driver 400 is connected to the gate lines G1 to Gn of the display panel 300 to apply the gate signals to the gate lines G1 to Gn.

The data driver 500 receives data control signals CONT2 and output image signals DAT from the signal controller 600 and selects grayscale voltages corresponding to the output image signals DAT. The data driver 500 generates data voltages, which are analog data signals, from the output image signals DAT. The output image signal DAT, which is a digital signal, has a predefined value (or grayscale). The data control signal CONT2 includes horizontal synchronization start signals, which start the transmission of the output image signals DAT for one row of pixels PX, a data load signal TP instructing the data driver 500 to apply the data voltages to the data lines D1 to D2, and a data clock signal. The data control signal CONT2 may further include an inversion signal for inverting a polarity of the data voltage for a common voltage Vcom (referred to as a polarity of the data voltage). The data driver 500 is connected to the data lines D1 to Dm of the display panel 300 to apply the data voltages Vd to corresponding data lines D1 to Dm.

Unlike a form shown in FIG. 1, the data driver 500 may also include a pair of data drivers (not shown) positioned at upper and lower portions and facing each other with a display area in which the plurality of pixels PX of the display panel 300 are positioned being interposed therebetween. In this case, the data driver positioned at the upper portion may apply the data voltages Vd above the data lines D1 to Dm of the display panel 300, and the data driver positioned at the lower portion may apply the data voltages Vd below the data lines D1 to Dm of the display panel 300. In addition, the data lines D1 to Dm connected to the data driver positioned at the lower portion and the data lines D1 to Dm connected to the data driver positioned at the upper portion may also be separated from each other.

The signal controller 600 receives input image signals IDAT and input control signals ICON controlling the display of the input image signals from an external graphics processor (not shown), and the like. The signal controller 600 processes the input image signals IDAT based on the input control signals ICON to convert the input image signals IDAT into the output image signals DAT. The signal controller 600 generates the gate control signals CONT1, the data control signals CONT2, and the like, based on the input image signals IDAT and the input control signals ICON. The signal controller 600 transmits the gate control signals CONT1 to the gate driver 400, and transmits the data control signals CONT2 and the processed output image signals DAT to the data driver 500.

Referring to FIG. 1, the signal controller 600 according to an exemplary embodiment includes a signal adjusting unit 650 adjusting the input image signals IDAT. The signal adjusting unit 650 may adjust the input image signals IDAT based on the positions of the pixels of the display panel 300 and a previous input image signal of the same data line, and an image pattern to generate adjusted image signals.

Referring to FIG. 2, the signal adjusting unit 650 according to an exemplary embodiment may include a first adjuster 610. The first adjuster 610 includes a plurality of first lookup tables 615. A description for other components shown in FIG. 2 will be provided later.

The first adjuster 610 receives the input image signals IDAT and adjusts the input image signals IDAT with reference to the first lookup table 615 to output adjusted image signals IDAT1.

The first lookup table 615 stores adjusted values for some or all of the grayscales of the input image signals IDAT.

Referring to FIGS. 3 and 4, the plurality of first lookup tables 615 may correspond to different positions of the display panel 300, and adjusted values stored in the respective first lookup tables 615 corresponding to those positions may be accordingly different from each other.

A first region A1, a second region A2, and a third region A3, which are different regions in the display panel 300, will be described by way of example with reference to FIG. 3.

The first region A1, the second region A2, and the third region A3 correspond to different rows of the display panel 300 charged with the data voltage Vd based on different gate signals. The distance from the data driver 500 becomes greater for the sequence of the first region A1, the second region A2, and the third region A3.

In this case, the first lookup table 615 may include a lookup table LUT1 corresponding to the first region A1, a lookup table LUT2 corresponding to the second region A2, and a lookup table LUT3 corresponding to the third region A3, as shown in FIG. 4. However, an exemplary embodiment is not limited thereto. That is, the first lookup table 615 may also include a plurality of lookup tables each corresponding to two or four or more regions positioned at different distances based on the data driver 500.

As the distance from the data driver 500 becomes greater, a larger signal delay occurs when applying the gate voltage Vd. Therefore, in order to compensate for the signal delay when applying the data voltage Vd a lookup table may be used. The lookup table (for example, the lookup table LUT3 of FIG. 4) corresponding to a region positioned at a place further away from the data driver 500, may store a larger adjusted value of a gray scale as compared to the adjusted value of the same gray scale stored by a lookup table (for example, the lookup table LUT1 of FIG. 4) corresponding to a region positioned closer to the data driver 500.

Referring to FIG. 5, the first lookup table may store adjusted values that depend on a previous input image signal IDAT for a previous pixel PX connected to a k-th gate line Gk ($0<k<I$, where k indicates a natural number) before an i-th gate line. The first lookup table may also store current input image signal IDAT for a current pixel connected to the i-th gate line Gi ($i=1, \ldots, n$). The previous input image signal IDAT refers to the input image signal IDAT for pixel PX immediately before the current pixel PX is charged. Hereinafter, an adjustment target pixel PX of the input signal will be called a corresponding or current pixel PX.

That is, the first lookup table 615 may store adjusted values that depend on a previous input image signal IDAT corresponding to another pixel PX positioned in a row previous to a row to which a pixel PX corresponding to a current input image signal IDAT belongs.

For example, when it is intended to calculate an adjusted value for a current input image signal IDAT for a data voltage Vd to be charged in an i-th row, the adjusted value may be calculated with reference to both of a grayscale value of the current input image signal IDAT and a grayscale value of a previous input image signal IDAT. The adjusted value may then determine the data voltage Vd to be charged in a k-th row and the adjusted value may be stored in the first lookup table 615. Here, the data voltage Vd to be charged in the k-th row does not simply mean a data voltage Vd to be charged in a row immediately prior to the i-th row, but means a data voltage that is applied immediately before the data voltage is applied in the i-th row. In this case, a pulse of a data load signal TP with which the data voltage Vd to be charged in the i-th row is synchronized and a pulse of a data load signal TP with which the data voltage Vd to be charged in the k-th row is synchronized may immediately neighbor each other. In this case, k may be smaller than i. As described above, the input image signal IDAT for the data voltage Vd to be charged in the k-th row is called a previous input image signal, and the input image signal IDAT for the data voltage to be charged in the i-th row is called a current input image signal.

The signal controller 600 according to an exemplary embodiment may further include at least one line memory 60 storing the previous input image signal.

The adjusted value needed to compensate the image signal of a current pixel based on the position of the pixel in the display panel 300 is obtained from the combination of values from the first lookup table 615 based on the display position of the current row to be charged, the current input image signal, and the previous input image signal, such that a charging rate of the data voltage Vd is determined.

As the number of grayscale values of the current input image signal and the previous input image signal stored in the first lookup table 615 increases, the compensation may be more accurately performed. However, as the size of each first lookup table 615 becomes large, the manufacturing cost of the display device increases. Therefore, the number of grayscale values stored in each first lookup table 615 may be appropriately determined in consideration of this problem.

FIG. 5 shows an example in which each first lookup table 615 stores adjusted values for some of the grayscales of a current input image signal and a previous input image signal. In this case, adjusted values for grayscales that are not stored in the first lookup table may be obtained by various calculation methods, such as interpolation and the like.

Likewise, as the number of first lookup tables 615 increases, the charging rate for a target row may be more accurately compensated based on the positions of those target rows in the display panel 300. However, as the number of first lookup tables 615 increases, the manufacturing cost of the display device increases. Therefore, the number of first lookup tables 615 may be appropriately determined in consideration of this problem. With respect to regions of the display panel 300 that do not have first lookup tables 615 corresponding thereto, adjusted values may be calculated by various calculation methods such as interpolation using the adjusted values of the neighboring first lookup tables 615, and the like.

According to an exemplary embodiment, adjusted values positioned at the boundaries of neighboring lookup tables LUT1, LUT2, and LUT3 may be changed if necessary.

According to an exemplary embodiment, the first lookup table may also include separate lookup tables depending on temperatures of the display device or the vicinity or the polarity of the data voltage Vd as well as the positions in the display panel 300.

Referring to FIG. 6, according to an exemplary embodiment, the first lookup table 615 may include a plurality of lookup tables corresponding to different positions in the row direction among regions of the display panel 300 positioned at the same distance from the data driver 500. For example, the first lookup table 615 may include a plurality of lookup tables LUT11, LUT12, and LUT13 corresponding to the first region A1, a plurality of lookup tables LUT21, LUT22, and LUT23 corresponding to the second region A2, and a plurality of lookup tables LUT31, LUT32, and LUT33 corresponding to the third region A3. A plurality of lookup tables corresponding to one row may correspond to different positions in one row.

Even in the case in which regions are positioned at the same distance from the data driver 500, they may be connected to different driving circuits depending on positions in a horizontal direction. In addition, a deviation may occur in the thin film transistors or the signal lines, the data lines or the like due to the manufacturing process, such that varying degrees of signal delays may occur in the same row depending on the positions in the horizontal direction. Therefore, as shown in FIG. 6, the plurality of lookup tables are provided with respect to the same row, and the current input image signal is compensated using the plurality of lookup tables, thereby making it possible to compensate for the deviation of the signal delays in different positions in the horizontal direction of the display panel 300 as well as current image signal compensation in the vertical direction of the display panel 300.

Also in this case, with respect to regions of the display panel 300 that do not have lookup tables corresponding thereto, adjusted values may be calculated by calculation methods such as interpolation using the adjusted values of the neighboring lookup tables, and the like. Here, the adjusted value may be calculated using the adjusted values of two neighboring lookup tables. Or, the adjusted value may be calculated using the adjusted values of four neighboring lookup tables.

For example, in the case for which the adjusted values of a position is to be calculated using interpolation, if the position is inside a quadrangle formed by connecting four points on display corresponding to four lookup tables LUT21, LUT22, LUT31, and LUT32 in FIG. 6, then the adjusted value at this position may be calculated by interpolation using adjusted values of the four lookup tables LUT21, LUT22, LUT31, and LUT32.

Compensating an input image signal using the previous input signal referenced in a first lookup table 615 will be described with reference to FIGS. 7 to 9.

Figure 7:
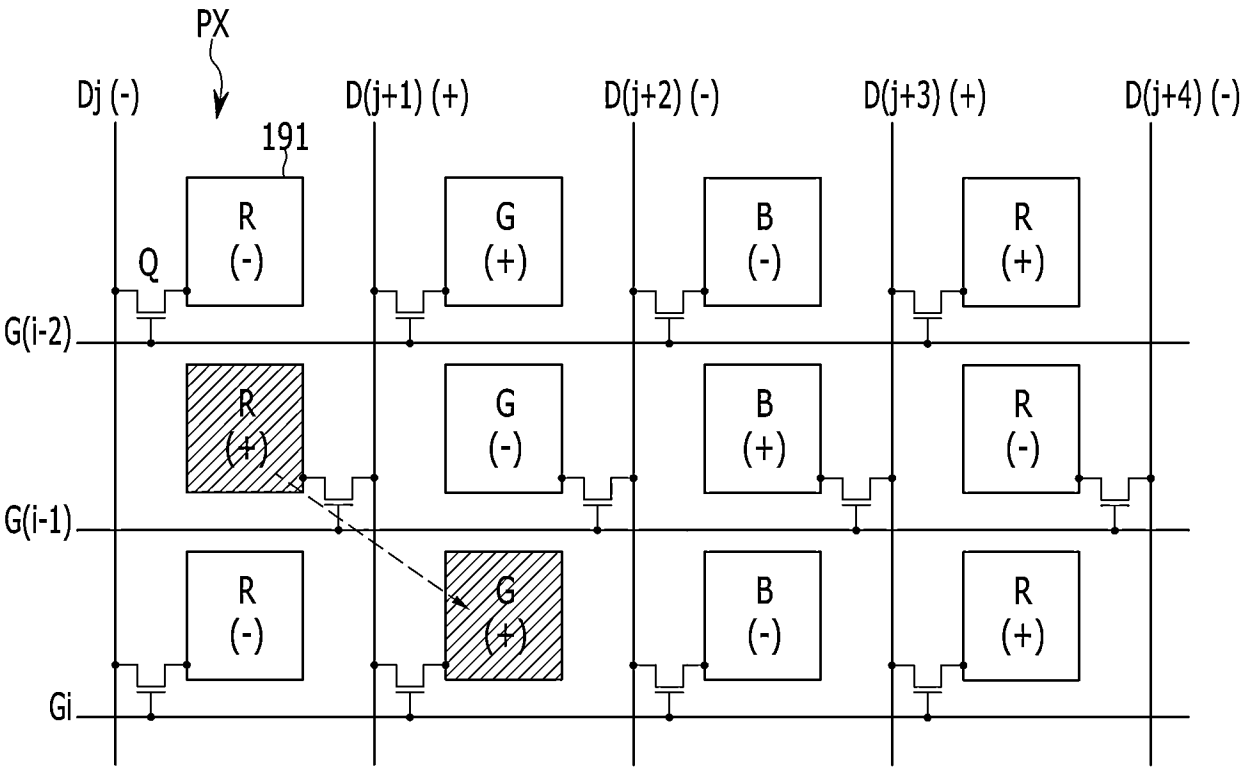
FIGS. 7 to 9 are schematic layout views of pixels and signal lines of the display device according to exemplary embodiments.
Figure 8:
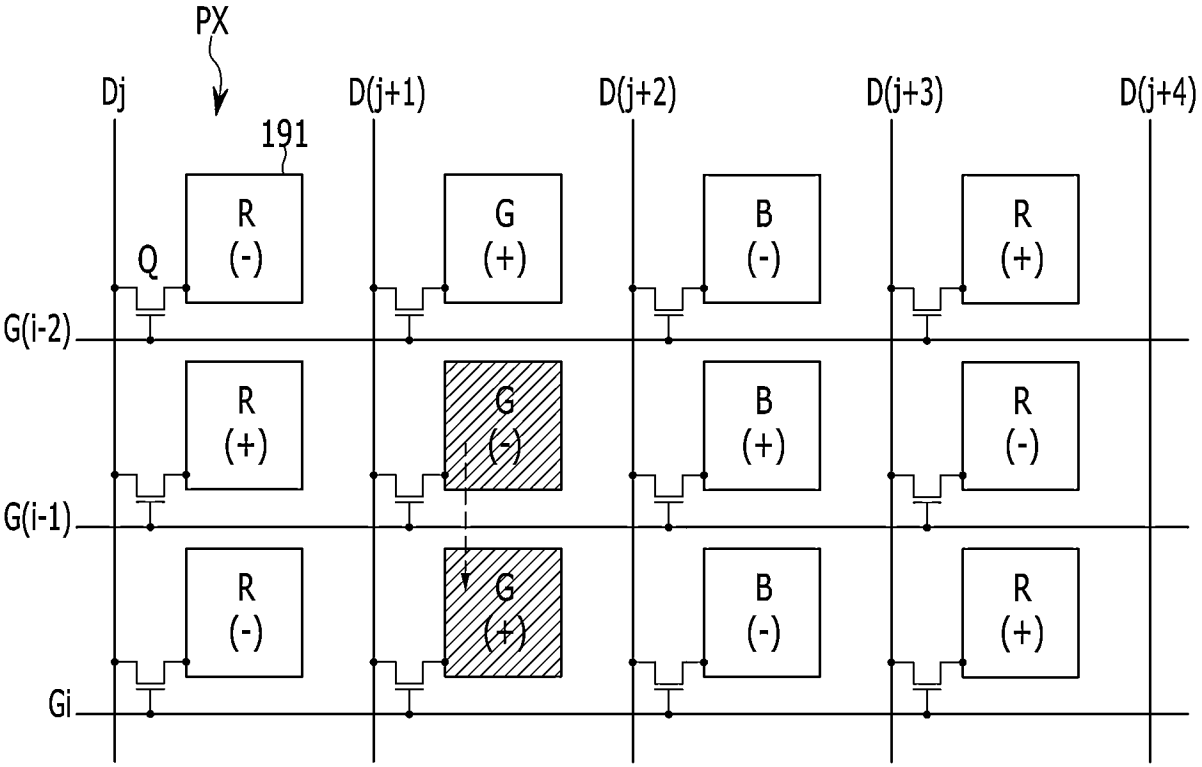
Figure 9:
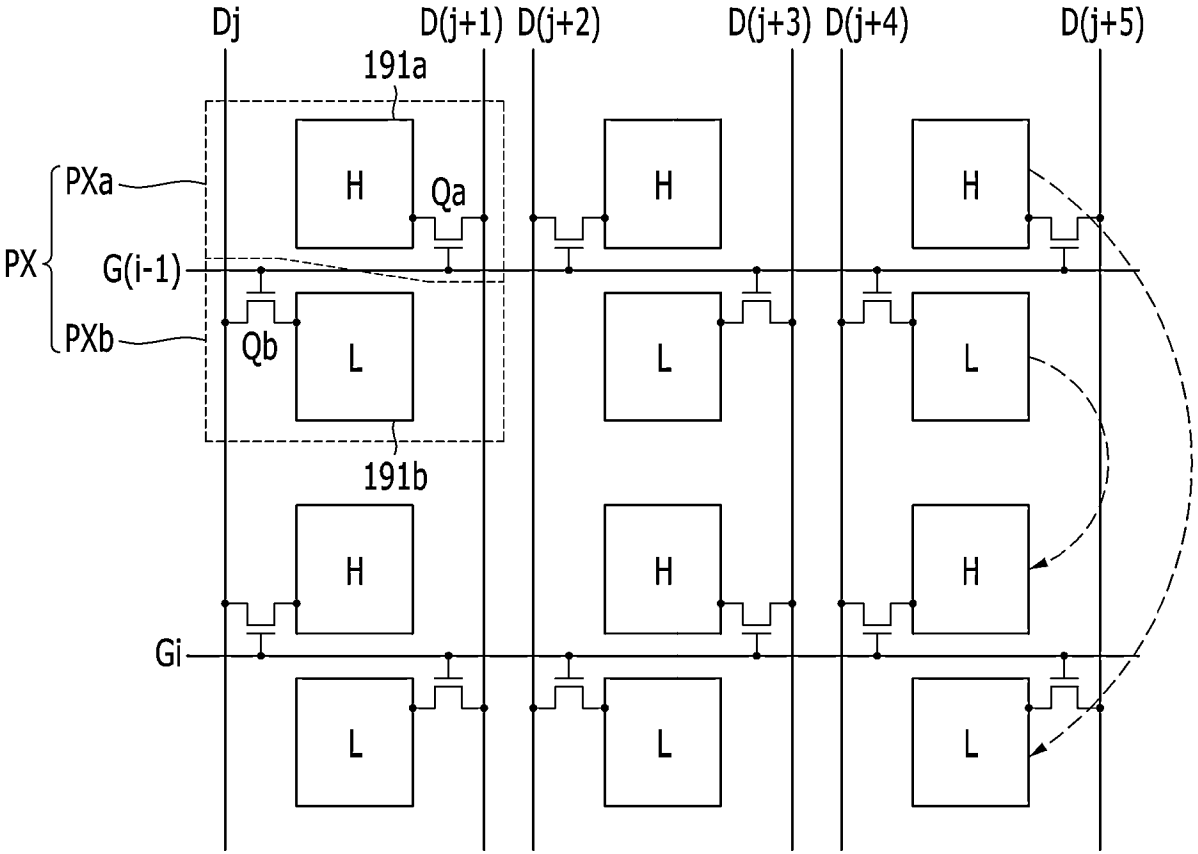

FIGS. 7 to 9 are schematic layout views of pixels and signal lines of a display device according to several exemplary embodiments.

First, referring to FIG. 7, the display panel 300 of the display device according to an exemplary embodiment includes a plurality of gate lines G(i−2), G(i−1), and Gi extended in the row direction, a plurality of data lines Dj, D(j+1), . . . extended in the column direction, and a plurality of pixels PX. The pixels PX may include pixel electrodes 191 connected to the gate lines G(i−2), G(i−1), and Gi and the data lines Dj, D(j+1), . . . through switching elements Q. Although the case in which each pixel PX represents primary colors of red R, green G, and blue B has been described in the present exemplary embodiment, the disclosure is not limited thereto.

Pixels representing the same primary colors R, G, or B may be disposed in one pixel column. Hereinafter, a pixel representing any one primary color will be denoted by the same sign as the sign of that primary color.

For example, pixel columns of red pixels R, pixel columns of green pixels G, and pixel columns of blue pixels B may be alternately disposed. One data line of Dj, D(j+1), . . . may be disposed per pixel column and one gate line of G(i−2), G(i−1), and Gi may be disposed per pixel row, but embodiments are not limited thereto.

Pixels R, G, and B disposed in one pixel column to represent the same primary colors may be connected between any one of two adjacent data lines Dj and D(j+1). As shown in FIG. 7, the pixels R, G, and B disposed in one pixel column may be alternately connected between two adjacent data lines Dj and D(j+1). Pixels R, G, and B positioned in the same pixel row may be connected to the same gate lines G(i−2), G(i−1), and Gi.

Data voltages having opposite polarities may be applied to the data lines Dj, D(j+1), etc. The polarity of the data voltages may be inverted per frame.

Therefore, data voltages having opposite polarities may be applied to pixels R, G, and B neighboring each other in the column direction and data voltages having opposite polarities may be applied to pixels R, G, and B neighboring each other in one pixel column, such that the pixels of the display panel may be driven in an approximate 1×1 dot inversion form. That is, even though the data lines Dj, D(j+1), . . . are driven in a column inversion form, the data voltages applied to the data lines Dj, D(j+1), . . . maintain the same polarity during one frame.

According to an exemplary embodiment shown in FIG. 7, when it is assumed that an input image signal IDAT corresponding to a data voltage Vd to be charged in a green pixel G connected to, for example, the gate line Gi is a current input image signal, the pixel PX charged with the data voltage Vd corresponding to a previous input image signal is a red pixel R connected to a previous gate line G(i−1). That is, the data line D(j+1) transfers the data voltage Vd of the red pixel R connected to the gate line G(i−1) and then transfers the data voltage Vd of the green pixel G connected to the next gate line Gi. An arrow shown in FIG. 7 indicates a sequence of pixels PX charged with the data voltage Vd of the data line D(j+1).

Therefore, in the display device according to an exemplary embodiment shown in FIG. 7, the previous input image signal, referenced in the first lookup table 615, is not an input image signal of a pixel PX immediately above a current pixel PX, but is an input image signal of a pixel PX neighboring the current pixel PX in a diagonal direction in the row above the current pixel PX.

A display device according to an exemplary embodiment shown in FIG. 8 may be substantially the same as the display device according to an exemplary embodiment shown in FIG. 7 described above, except that pixels R, G, and B disposed in one pixel column to represent the same primary colors are connected to the same data lines Dj, D(j+1), . . . . Data voltages having opposite polarities may be applied to the data lines of Dj, D(j+1), . . . adjacent to each other. In addition, as shown in FIG. 8, a polarity of a data voltage Vd applied to one data line of Dj, D(j+1), . . . may be inverted per row during one frame or may be constant during one frame.

According to an exemplary embodiment shown in FIG. 8, when it is assumed that input image signal IDAT corresponding to a data voltage Vd to be charged in a green pixel G connected to, for example, the gate line Gi among pixels PX connected to one data line (for example, data line D(j+1)) through the switching element Q is a current input image signal, a pixel PX charged with a data voltage Vd corresponding to a previous input image signal is a green pixel G connected to a previous gate line G(i−1). That is, the data line D(j+1) transfers the data voltage Vd of the green pixel G connected to the gate line G(i−1) and then transfers the data voltage Vd of the green pixel G connected to the next gate line Gi. An arrow shown in FIG. 8 indicates a sequence of pixels PX charged with the data voltage Vd of the data line D(j+1).

Therefore, in the display device according to an exemplary embodiment shown in FIG. 8, the previous input image signal which should be referenced in the first lookup table 615 may be an input image signal of a pixel PX immediately above a pixel PX corresponding to the current input image signal.

Next, referring to FIG. 9, each pixel of a display panel according to the present exemplary embodiment may include a first sub-pixel PXa and a second sub-pixel PXb. Since the first sub-pixel PXa may generally display an image having higher luminance as compared with the second sub-pixel PXb with respect to the same grayscale, the first sub-pixel PXa and the second sub-pixel PXb are denoted by "H" and "L", respectively in FIG. 9. But the embodiments of the present disclosure are not limited thereto.

Areas of the second sub-pixel PXb and the first sub-pixel PXa may be different from each other. In this case, a ratio between the area of the second sub-pixel PXb and the area of the first sub-pixel PXa may be approximately 2:1.

The first sub-pixel PXa includes a first sub-pixel electrode 191*a* connected to a first switching element Qa, and a second sub-pixel PXb includes a second sub-pixel electrode 191*a* connected to a second switching element Qb. The first switching element Qa and the second switching element Qb may be connected to the same gate lines of G(i−2), and G(i−1), Gi and different data lines of Dj, D(j+1), . . . , as shown in FIG. 9.

First sub-pixels PXa of pixels PX disposed in one pixel column may be alternately connected to two data lines of Dj, D(j+1), . . . adjacent to each other. Likewise, second sub-pixels PXa of the pixels PX disposed in one pixel column may be alternately connected to two data lines of Dj, D(j+1), . . . adjacent to each other. In addition, first and second sub-pixels PXa and PXb of pixels PX positioned in the same pixel row may be connected to the same gate lines of G(i−2), G(i−1), and Gi. Accordingly, each data line Dj, D(j+1), . . . can transmit a data voltage Vd of a first sub-pixel Pxa and a data voltage Vd of a second sub-pixel PXb respectively included in different pixels PX.

According to an exemplary embodiment shown in FIG. 9, when it is assumed that an input image signal IDAT corresponding to a data voltage Vd to be charged in a second sub-pixel PXb of a pixel connected to, for example, the gate line Gi among pixels PX connected to one data line (for example, data line D(j+5) is a current input image signal, a pixel PX charged with a data voltage Vd corresponding to a previous input image signal is a first sub-pixel PXa of a pixel PX connected to a previous gate line G(i−1). That is, the data line D(j+5) transfers the data voltage Vd of the first sub-pixel PXa of the pixel PX connected to the gate line G(i−1) and then transfers the data voltage Vd of the second sub-pixel PXb of the pixel PX connected to the next gate line Gi. Likewise, the data line D(j+4) transfers the data voltage Vd of the second sub-pixel PXb of the pixel PX connected to the gate line G(i−1) and then transfers the data voltage Vd of the first sub-pixel PXa of the pixel PX connected to the next gate line Gi. An arrow shown in FIG. 9 indicates a sequence of pixels PX charged with the data voltages Vd of the data line D(j+4) and the data line D(j+5).

Therefore, in the display device according to an exemplary embodiment shown in FIG. 9, the previous input image signal, which should be referenced in the first lookup table 615, is an input image signal IDAT of a second sub-pixel PXb of a pixel PX immediately above a sub-pixel corresponding to the current input image signal. In the case in which the sub-pixel is a first sub-pixel PXa and is an input image signal IDAT of a second sub-pixel PXb of a pixel PX immediately above a sub-pixel corresponding to the current input image signal in the case in which the sub-pixel is a second sub-pixel PXa.

In addition, structures of different display devices may be different. Therefore, the input image signal IDAT for the data voltage Vd to be charged in the k-th row, which is referenced in the first lookup table 615 may be changed.

Next, a driving method of a display device according to an exemplary embodiment will be described with reference to FIG. 10 together with FIGS. 1 to 9. Particularly, the case in which the signal controller 600 according to an exemplary embodiment has performed signal adjustment at the first adjuster 610 including the first lookup table 615 will be described.

Figure 10:
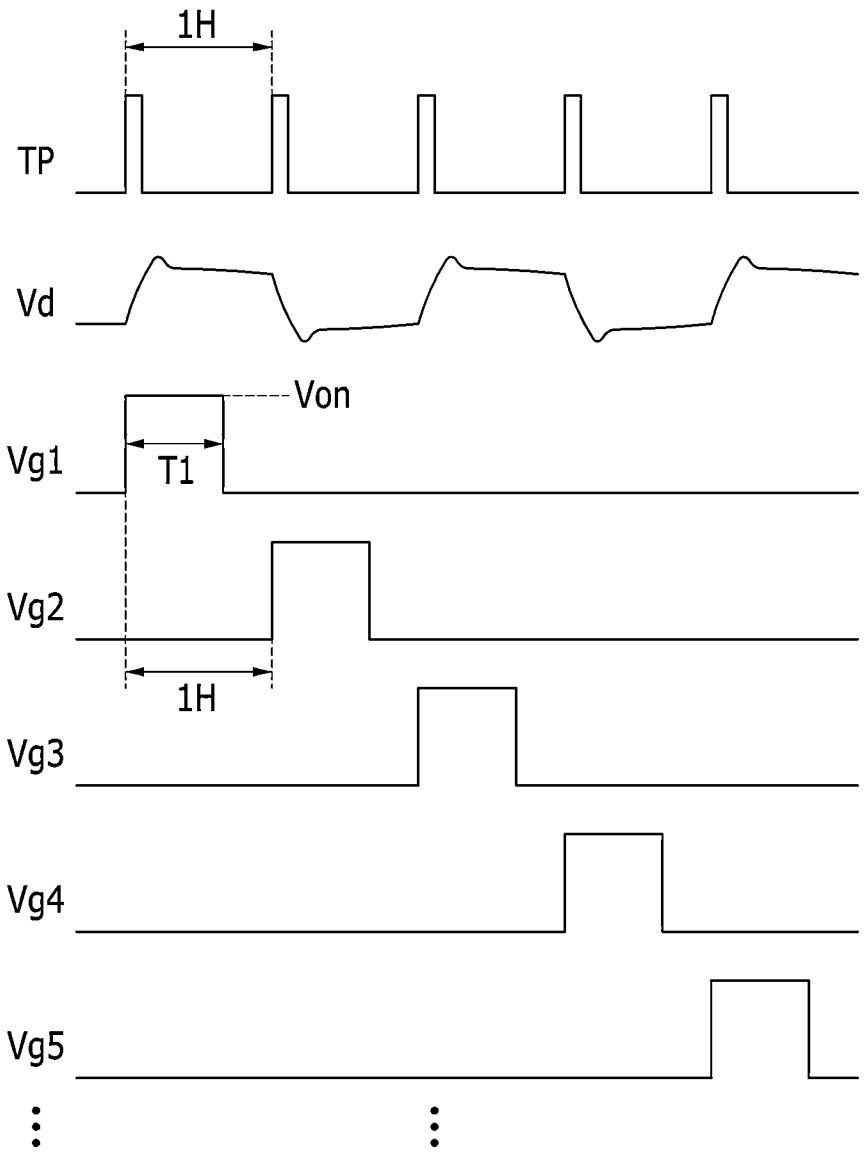
FIG. 10 is a timing diagram of the driving signals of the display device according to an exemplary embodiment.

FIG. 10 is a timing diagram of the driving signals of the display device according to an exemplary embodiment.

The signal controller 600 receives the input image signals IDAT and the input control signals ICON from the outside and then selects or calculates the adjusted values with reference to the first lookup table 615 of the first adjuster 610. The signal controller 600 applies the calculated adjusted values to the current input image signal to generate the adjusted image signals IDAT1

The adjusted image signals IDAT1 may be calculated by, for example, adding the adjusted values to the current input image signal. The signal controller 600 processes the adjusted image signals IDAT1 to convert the adjusted image signals into the output image signals DAT and generate the gate control signals CONT1, the data control signals CONT2, and the like.

The signal controller 600 transmits the gate control signals CONT1 to the gate driver 400 and transmits the data control signals CONT2 and the output image signals DAT to the data driver 500.

The data driver 500 receives the output image signals DAT for one row of pixels PX depending on the data control signals CONT2 from the signal controller 600, selects grayscale voltages corresponding to the respective output image signals DAT to convert the output image signals DAT into the data voltages Vd, which are analog data signals, and then applies the data voltages to the corresponding data lines D1 to Dm. In more detail, the data driver 500 sequentially applies the data voltages to the data lines D1 to Dm in synchronization with rising edges or falling edges of the data load signal TP. An interval between neighboring rising edges of the data load signal TP may be 1 horizontal period (1H).

The gate driver 400 applies the gate-on voltages Von to the gate lines G1 to Gn depending on the gate control signals CONT1 from the signal controller 600 to turn on the switching elements connected to the gate lines G1 to Gn. In this case, the data voltages Vd applied to the data lines D1 to Dm are applied to the corresponding pixels through the turned-on switching elements. In more detail, the gate driver 400 sequentially applies the gate-on voltages Von of the gate signals Vg1, Vg2, . . . to the gate lines G1 to Gn approximately in synchronization with the rising edges of the data load signal TP. An interval between rising edges of the gate-on voltages Von of the gate signals Vg1, Vg2, . . . applied to neighboring rows of gate lines G1 to Gn may be approximately 1H. That is, a period in which the gate-on voltages Von are sequentially applied to the gate lines G1 to Gn may be approximately 1H. A width of the gate-on voltage Von applied to one gate line G1 to Gn is denoted by a first time T1.

When the gate-on voltages Von are applied to the gate lines G1 to Gn, as described above, the switching elements connected to the gate lines G1 to Gn are turned on, and the data voltages Vd applied to the data lines D1 to Dm are applied to corresponding pixels PX through the turned-on switching elements.

A difference between the data voltage applied to the pixel PX and the common voltage Vcom appears as a pixel voltage. In a liquid crystal display, the pixel voltage is a charging voltage of a liquid crystal capacitor, and an arrangement of liquid crystal molecules is changed depending on a magnitude of the pixel voltage. Therefore, polarization of light passing through a liquid crystal layer is changed. The change of the polarization appears as a change in transmittance of the light by a polarizer attached to the liquid crystal display.

The gate-on voltages V-on are applied to all of the gate lines G1 to Gn to apply the data signals to all of the pixels PX, thereby making it possible to display an image of one frame.

Although an example of row inversion driving in which the data voltage Vd is inverted per row is shown in FIG. 10, the present disclosure is not limited thereto. That is, a polarity of the data voltages Vd applied to one data line D1 to Dm may be constant during one frame.

When one frame ends, the next frame starts, and a state of an inversion signal applied to the data driver 500 may be controlled so that a polarity of the data voltage applied to each pixel PX is inverted with respect to that of the data voltage in the previous frame. Here, even within one frame, according to characteristics of the inversion signal, as shown in FIG. 10, a polarity of the data voltage Vd flowing through one of data lines D1 to Dm may be periodically changed, or polarities of the data voltages Vd applied to adjacent pixels of a row may be different from each other.

As described above, since the input image signals IDAT are adjusted by the first adjuster 610 depending on the positions of the pixels PX in the display panel 300 such as the distances from the data driver 500, or the like, and the data voltage Vd charged immediately before the pixel PX is charged through the same data line D1 to Dm and then the adjusted input image signals are converted into the data voltages Vd to charge one row of pixels PX, a deviation of charging rates depending on the positions of the display panel 300 may be compensated. Therefore, an image quality defect such as a spot due to charging caused by insufficiency of the charging rates depending on the positions may be removed.

Next, a driving method of a display device according to other exemplary embodiments will be described with reference to FIGS. 11 to 17 together with the drawings described above.

Figure 11:
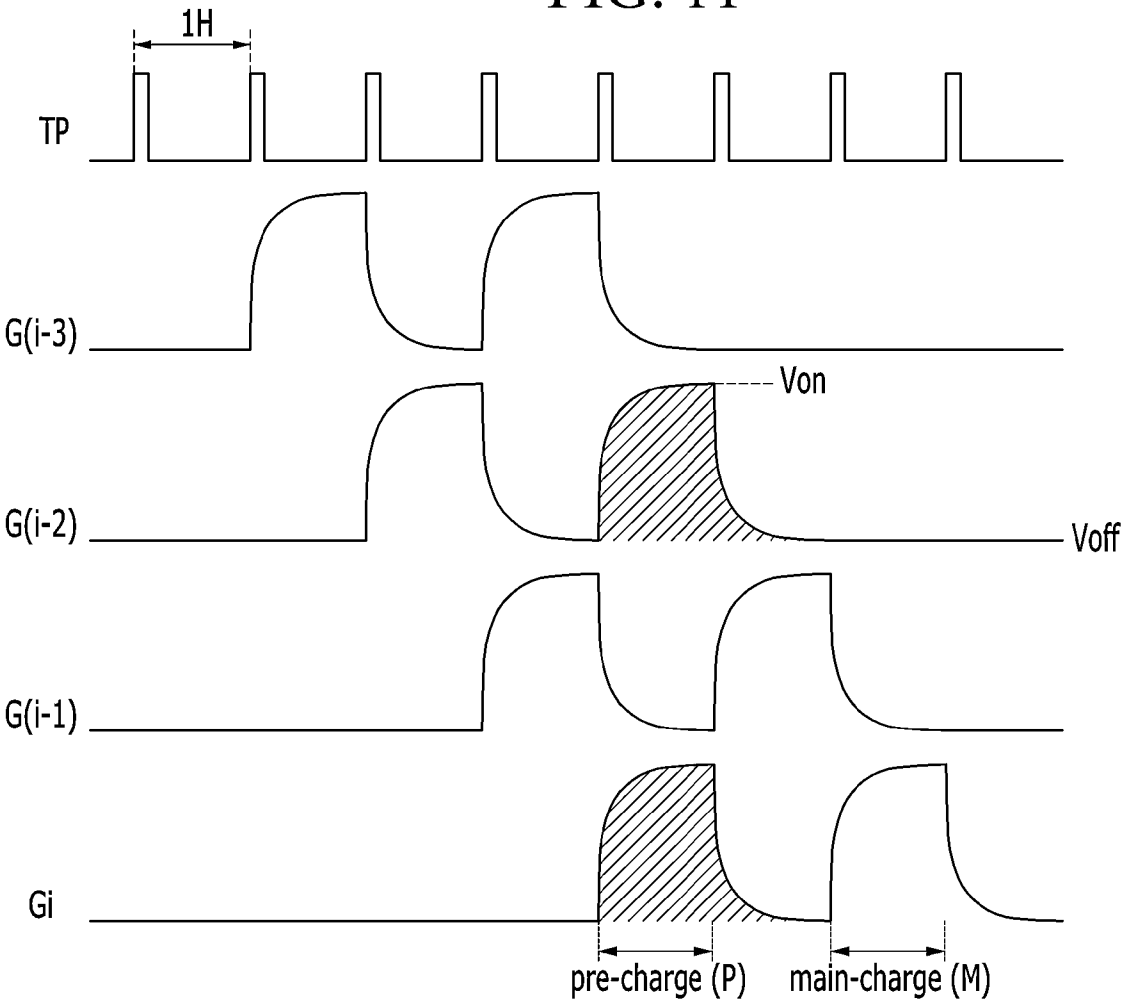
FIGS. 11 to 13 are timing diagrams of the driving signals of the display device according to an exemplary embodiment.
Figure 12:
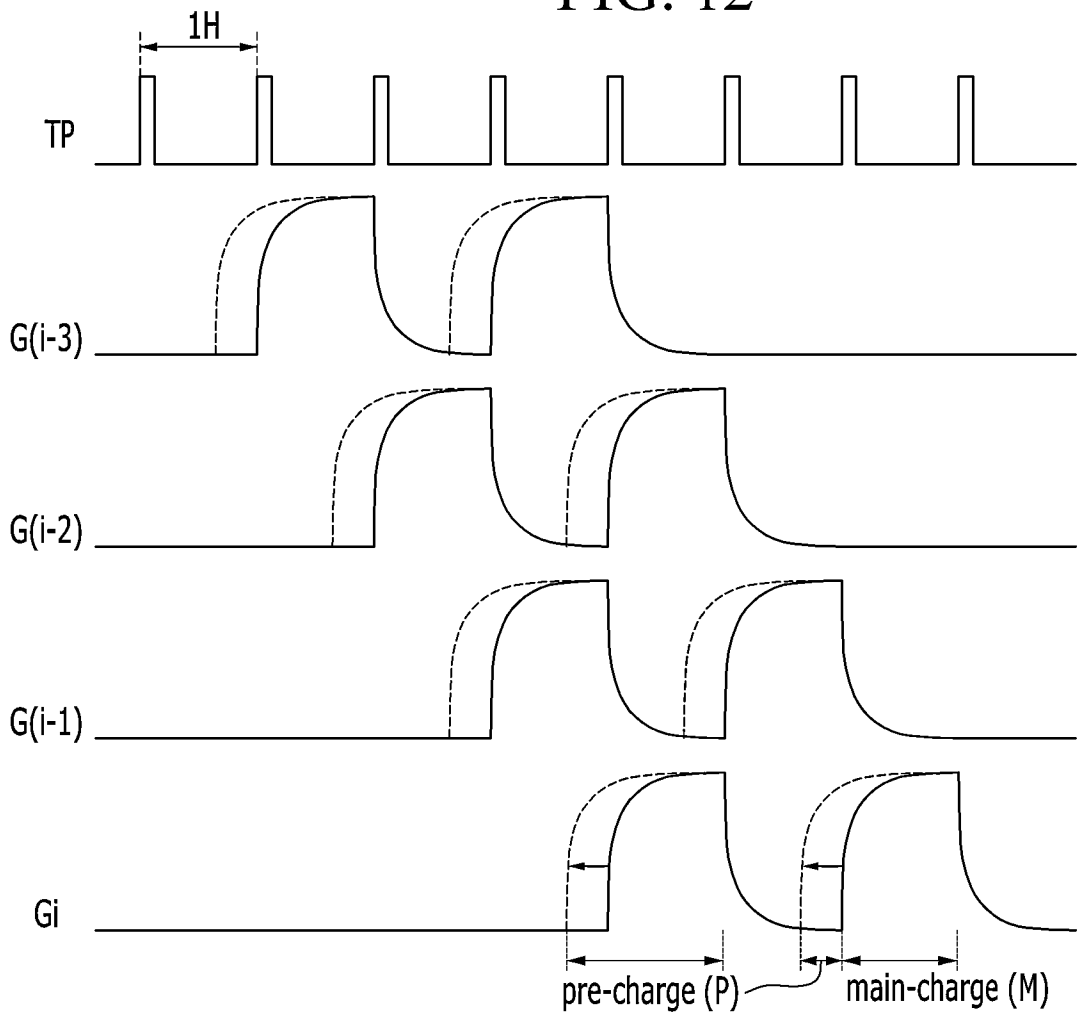
Figure 13:
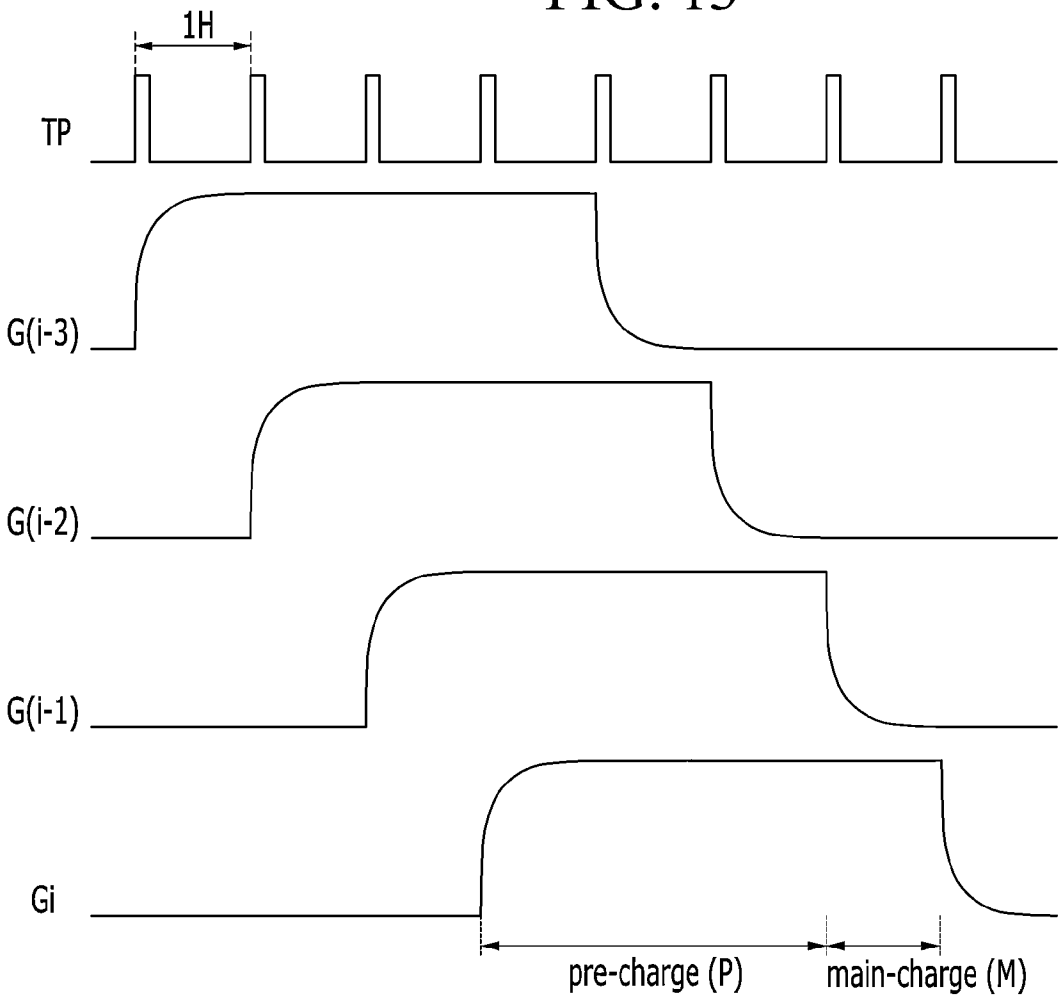
Figure 14:
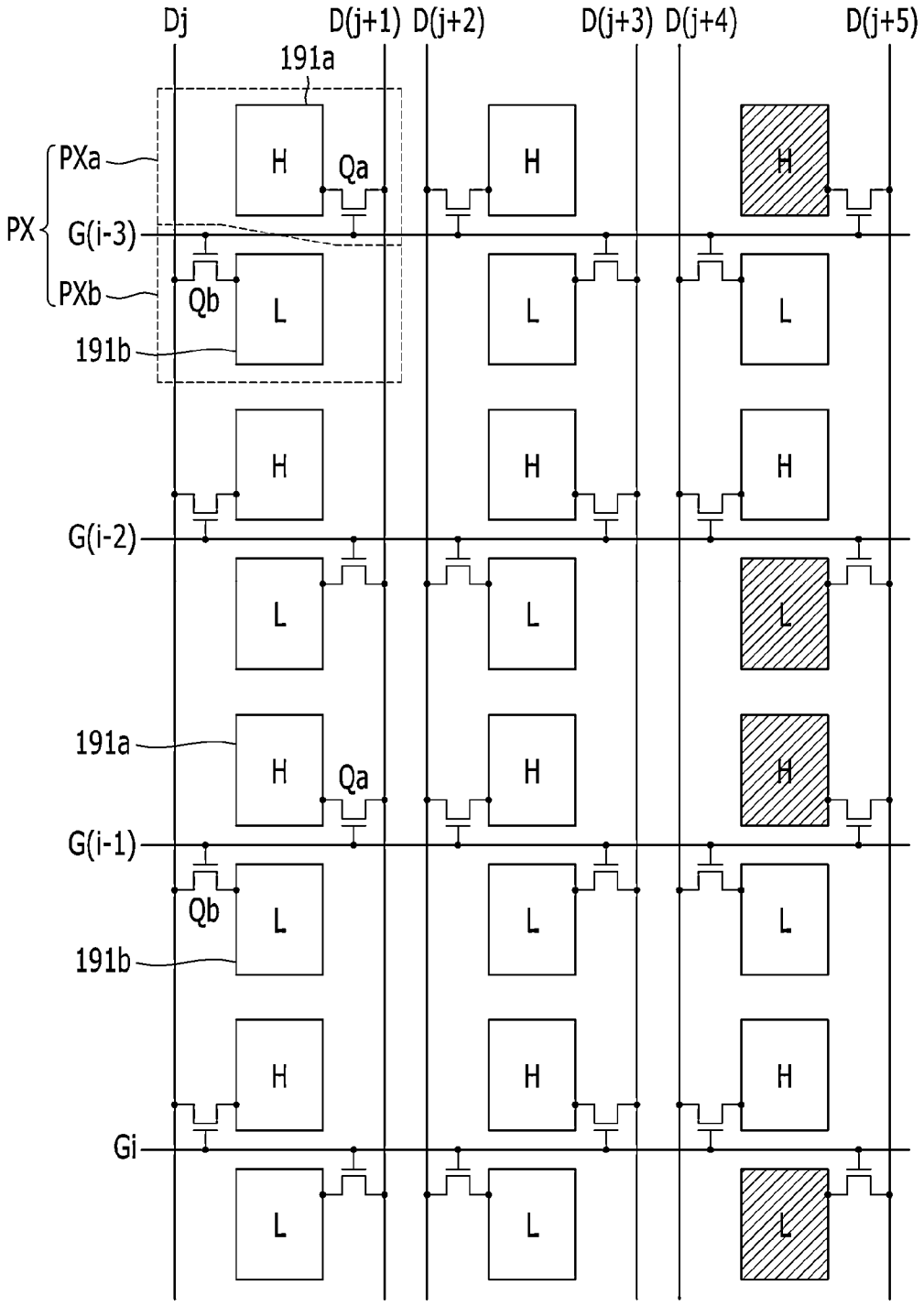
FIG. 14 is a schematic layout view of pixels and signal lines of the display device according to an exemplary embodiment.

FIGS. 11 to 13 are timing diagrams of the driving signals of the display device according to exemplary embodiments. FIG. 14 is a schematic layout view of pixels and signal lines of the display device according to an exemplary embodiment.

Referring to FIGS. 11 to 13, a driving method of a display device according to an exemplary embodiment may be substantially the same as the driving method according to an exemplary embodiment shown in FIG. 10 described above, except for a gate signal applied to a gate line . . . , G(i−3), G(i−2), G(i−1), Gi, . . . connected to each row.

First, referring to FIG. 11, a gate signal applied to each gate line . . . , G(i−3), G(i−2), G(i−1), Gi, . . . may include two gate-on voltage Von pulses (referred to as "gate-on pulses") spaced apart from each other. A width of each gate-on pulse may be approximately 1H.

When the latter of the two gate-on pulses is applied to one pixel PX, the pixel PX is mainly charged with a data voltage Vd corresponding thereto, and a period in which the pixel is mainly charged is called a main-charging period M. When the former of the two gate-on pulses is applied to the pixel PX before the pixel PX is mainly charged, the pixel PX is pre-charged with a data voltage Vd corresponding to another pixel PX, and a period in which the pixel is pre-charged is called a pre-charging period P. Here, another pixel PX corresponding to the data voltage Vd pre-charged in the pixel is a pixel having an effect on pre-charging of the pre-charged corresponding pixel.

For example, a pixel PX connected to an i-th gate line Gi may be pre-charged with a data voltage Vd corresponding to another pixel PX connected to an i−2-th gate line G(i−2) in a pre-charging period P. Therefore, a pre-charging period P of the pixel PX connected to the i-th gate line Gi may overlap with a main-charging period M of another pixel PX connected to the (i−2)-th gate line G(i−2). In this case, the pre-charged pixel PX and another pixel having an effect on the pre-charging may represent the same primary color as in an exemplary embodiment shown in FIGS. 7 to 9 described above. In addition, the data voltage of the pre-charged pixel PX may have the same polarity as that of another pixel having an effect on the pre-charging.

Referring to FIGS. 12 and 13, a driving method of a display device according to an exemplary embodiment may be substantially the same as the driving method according to an exemplary embodiment shown in FIG. 11 described above, except that a width of a gate-on pulse applied to each gate line . . . , G(i−3), G(i−2), G(i−1), Gi, . . . is larger than that of the gate-on pulse in the driving method according to the exemplary embodiment shown in FIG. 11. That is, each gate-on pulse may be extended leftward so as to overlap with a portion of a main-charging period M or a pre-charging period P of a previous row of pixel PX. Therefore, a width of the gate-on pulse may be approximately 1H or more to approximately 2H or less.

FIG. 13 shows the case in which a width of a gate-on pulse extended from the gate signal shown in FIG. 12 is approximately 2H. In this case, the two gate-on pulses spaced apart from each other as shown in FIG. 11 are connected to each other, such that each gate signal may include only one gate-on pulse. In this case, a final 1H period of one gate-on pulse corresponds to a main-charging period M, and a remaining 3H period in front of the pre-charging period corresponds to a pre-charging period P.

As shown in FIGS. 11 to 13, a corresponding pixel PX is pre-charged with a data voltage Vd of a previous row of another pixel PX before being mainly charged with a data voltage Vd thereto, thereby making it possible to increase a charging rate of the corresponding pixel PX.

For example, referring to FIGS. 11 and 14, a display device according to an exemplary embodiment may have the same structure and connection relationship as those of the display device according to an exemplary embodiment shown in FIG. 9 described above. In the case in which the display device according to the present exemplary embodiment is driven depending on a driving waveform shown in FIG. 11, for example, a data voltage Vd with which a second sub-pixel PXb connected to a gate line Gi is charged in a pre-charging period P, may be a data voltage Vd applied in a main-charging period M of a second sub-pixel PXb connected to a gate line G(i−2) previous to the gate line Gi by two rows and the same data line D(j+5). That is, a sub-pixel having an effect on the pre-charging of the second sub-pixel PXb connected to the gate line Gi may be the second sub-pixel PXb connected to the gate line G(i−2) previous to the gate line Gi by two rows and the same data line D(j+5).

On the other hand, in the case in which the display device is driven according to a driving waveform shown in FIG. 13, for example, a data voltage Vd with which a second sub-pixel PXb connected to a gate line Gi is charged in a pre-charging period P, may be a data voltage Vd applied in a main-charging period M of a first sub-pixel PXa or a second sub-pixel PXb connected to gate lines G(i−1), G(i−2), and G(i−3) previous to the gate line Gi by one row, two rows, and three rows, and the same data line D(j+5), as shown in FIG. 14.

Figure 15:
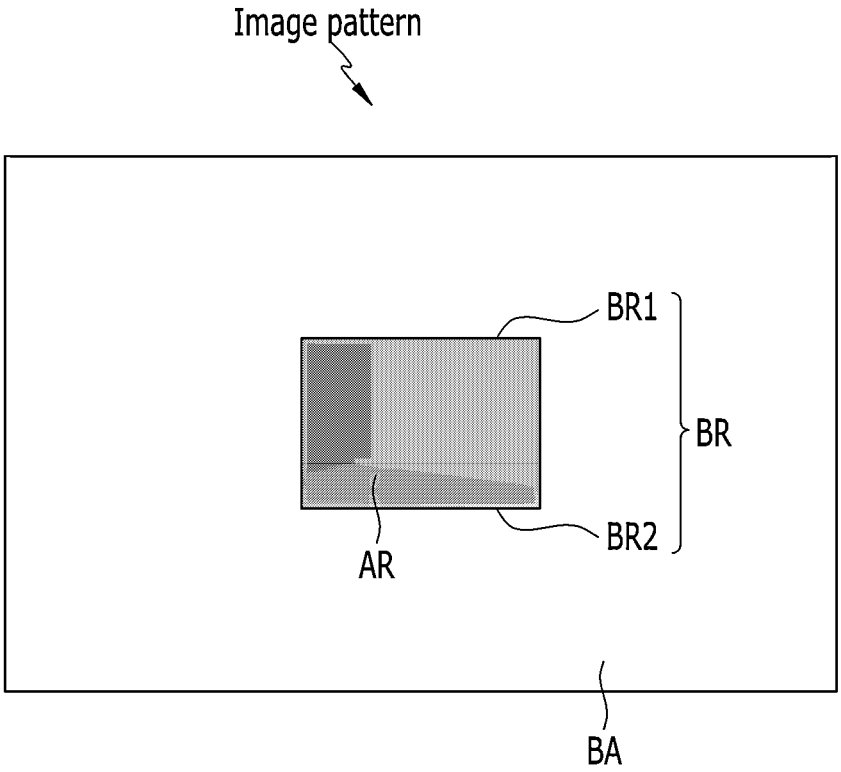
FIG. 15 is a diagram showing an example of an image pattern displayed by a display device according to an exemplary embodiment.

The case in which the display device according to an exemplary embodiment displays an image pattern as shown in FIG. 15 will now be described.

FIG. 15 is a diagram showing an example of an image pattern displayed by the display device according to an exemplary embodiment.

Referring to FIG. 15, an image pattern according to an exemplary embodiment may represent a grayscale different from that of a background BA. The image pattern includes an area region AR representing a different grayscale from that of the background BA. The image pattern also includes a boundary region BR, which is a boundary between the area region AR and the background BA. Therefore, when viewed in a vertical direction, which is a column direction, grayscales of an upper row of pixels PX and a lower row of pixels PX are different from each other based on the boundary region BR. Although FIG. 15 shows an example in which a grayscale of the area region AR of the image pattern is constant and is lower than that of the background BA, the present disclosure is not limited thereto.

The boundary region BR may include an upper boundary region BR1 including an upper boundary of the image pattern and a lower boundary region BR2 including a lower boundary of the image pattern.

The case in which the display device displays the image pattern shown in FIG. 15 by one of the driving methods shown in FIG. 11 to FIG. 13 will be described with reference to FIGS. 16 and 17.

Figure 16:
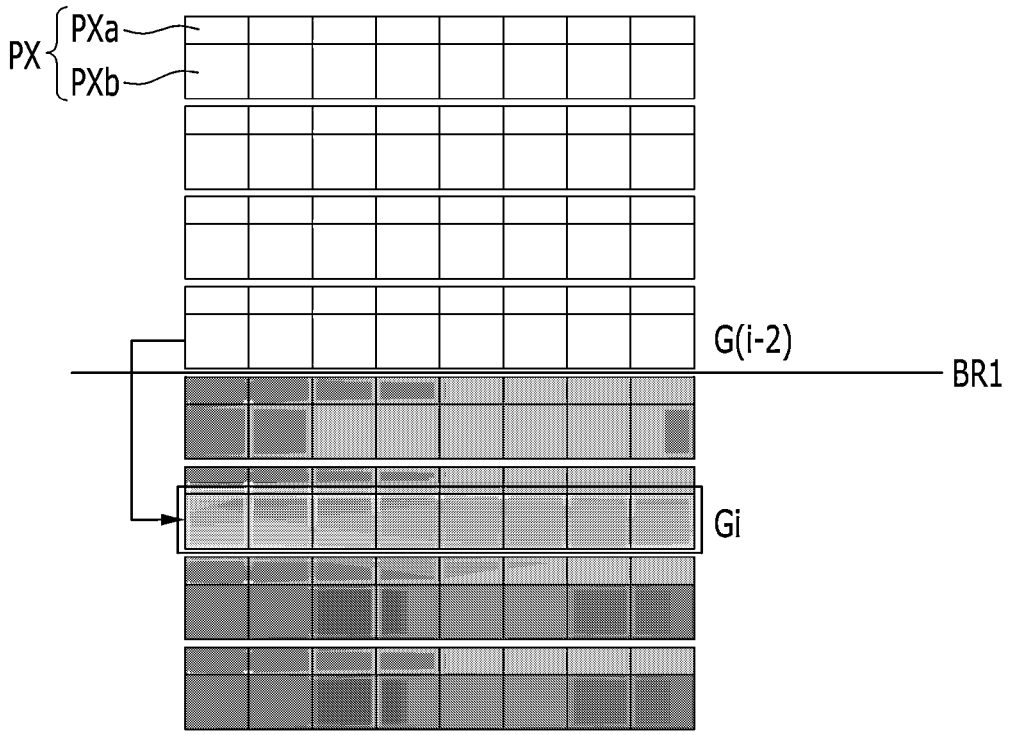
FIG. 16 is a diagram showing luminance represented by each pixel of an upper boundary region when the image pattern shown in FIG. 15 is displayed by a driving method according to an exemplary embodiment.
Figure 17:
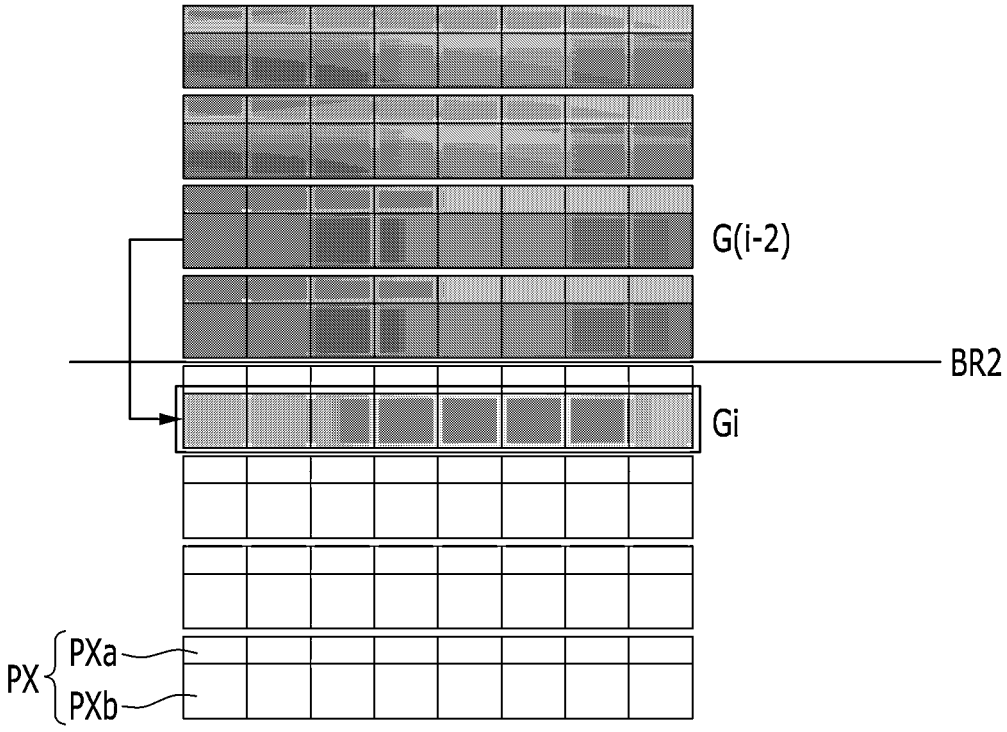
FIG. 17 is a diagram showing luminance represented by each pixel of a lower boundary region when the image pattern shown in FIG. 15 is displayed by the driving method according to an exemplary embodiment.

FIG. 16 is a diagram showing luminance represented by each pixel of an upper boundary region when the image pattern shown in FIG. 15 is displayed by a driving method according to an exemplary embodiment, and FIG. 17 is a diagram showing luminance represented by each pixel of a lower boundary region when the image pattern shown in FIG. 15 is displayed by the driving method according to an exemplary embodiment.

The display device according to an exemplary embodiment may have the structure shown in FIG. 14 described above. When all grayscales that may be represented by a pixel PX are, for example, 0 to 255, a grayscale represented by a first sub-pixel PXa of a pixel PX representing the background BA of the image pattern according to an exemplary embodiment shown in FIG. 15 may be, for example, 255, and a grayscale represented by a second sub-pixel PXb thereof may be, for example, 240. In addition, a grayscale represented by a first sub-pixel PXa of a pixel PX representing the area region AR of the image pattern may be, for example, 40, and a grayscale represented by a second sub-pixel PXb thereof may be, for example, 0.

However, the embodiments are not limited thereto. That is, each pixel PX may not be divided into two sub-pixels, but may receive only one data voltage Vd applied thereto to display an image.

Referring to FIG. 16, a pixel PX connected to an i-th gate line Gi among pixels PX displaying the image pattern representing the lower grayscale than that of the background BA in the vicinity of the upper boundary region BR1 of the image pattern may be positioned below a predetermined number of rows, for example, one row, two rows, or three rows, below the upper boundary region BR1. FIG. 16 shows an example in which the pixel PX connected to the i-th gate line Gi is positioned below two rows based on the upper boundary region BR1.

In this case, according to the driving method shown in FIG. 11 described above, the pixel PX connected to the i-th gate line Gi may be pre-charged when the pixel PX connected to the i−2 gate line G(i−2), which is a gate line previous to the i-th gate line Gi by two rows, is mainly charged. On the other hand, according to the driving method shown in FIG. 13 described above, the pixel PX connected to the i-th gate line Gi may be pre-charged when the pixels PX connected to the gate lines G(i−1), G(i−2), and G(i−3) previous to the i-th gate line Gi by one row, two rows, and three rows are mainly charged, such that it may be affected by the image signal for these pixels PX.

Since the pixel PX having an effect on the pre-charging of the pixel PX connected to the i-th gate line Gi corresponds to the background BA, a grayscale represented by the data voltage Vd charged in the pixel PX connected to the i-th gate line Gi in the pre-charging period P of the pixel PX is higher than a grayscale represented by the data voltage Vd pre-charged in the pixel PX in the case in which both of the pixel PX having an effect on the pre-charging and the pre-charged pixel PX correspond to the image pattern. Therefore, the pixel PX connected to the i-th gate line Gi represents luminance higher than those of other pixels positioned therebelow even after the main-charging period M ends, such that a boundary of the upper boundary region BR1 may be viewed to be blurred, as shown in FIG. 16.

This is also applied to the pixel PX connected to the i−1-th gate line G(i−1) positioned below one row based on the upper boundary region BR1 or the pixel PX connected to the (i+1)-th gate line G(i+1) positioned below three rows based on the upper boundary region BR1.

Referring to FIG. 17, a pixel PX connected to an i-th gate line Gi among pixels PX displaying the background BA representing the higher grayscale than that of the image pattern in the vicinity of the lower boundary region BR2 of the image pattern may be positioned below a predetermined number of rows, for example, one row, two rows, or three rows, above the lower boundary region BR2. FIG. 17 shows an example in which the pixel PX connected to the i-th gate line Gi is positioned one row below the lower boundary region BR2.

In this case, according to the driving method shown in FIG. 11 described above, the pixel PX connected to the i-th gate line Gi may be pre-charged when the pixel PX connected to the i−2 gate line G(i−2), which is a gate line previous to the i-th gate line Gi by two rows, is mainly charged. On the other hand, according to the driving method shown in FIG. 13 described above, the pixel PX connected to the i-th gate line Gi may be pre-charged when the pixels PX connected to the gate lines G(i−1), G(i−2), and G(i−3) previous to the i-th gate line Gi by one row, two rows, and three rows are mainly charged, such that it may be affected by the image signal for these pixels PX.

Since the pixel PX having an effect on the pre-charging of the pixel PX connected to the i-th gate line Gi corresponds to the image pattern representing a low grayscale, a grayscale represented by the data voltage Vd charged in the pixel PX connected to the i-th gate line Gi in the pre-charging period P of the pixel PX is lower than a grayscale represented by the data voltage Vd pre-charged in the pixel PX in the case in which both of the pixel PX having an effect on the pre-charging and the pre-charged pixel PX correspond to the background BA. Therefore, the pixel PX connected to the i-th gate line Gi represents lower luminance than those of other pixels positioned therebelow even after the main-charging period M ends, such that a boundary of the lower boundary region BR2 may be viewed to be blurred, as shown in FIG. 17.

This is also applied to the pixel PX connected to the (i+1)-th gate line G(i+1) positioned below two rows based on the lower boundary region BR2 or the pixel PX connected to the (i+2)-th gate line G(i+2) positioned below three rows based on the lower boundary region BR2.

The display device according to an exemplary embodiment will now be described with reference to FIG. 18 together with FIG. 2.

Figure 18:
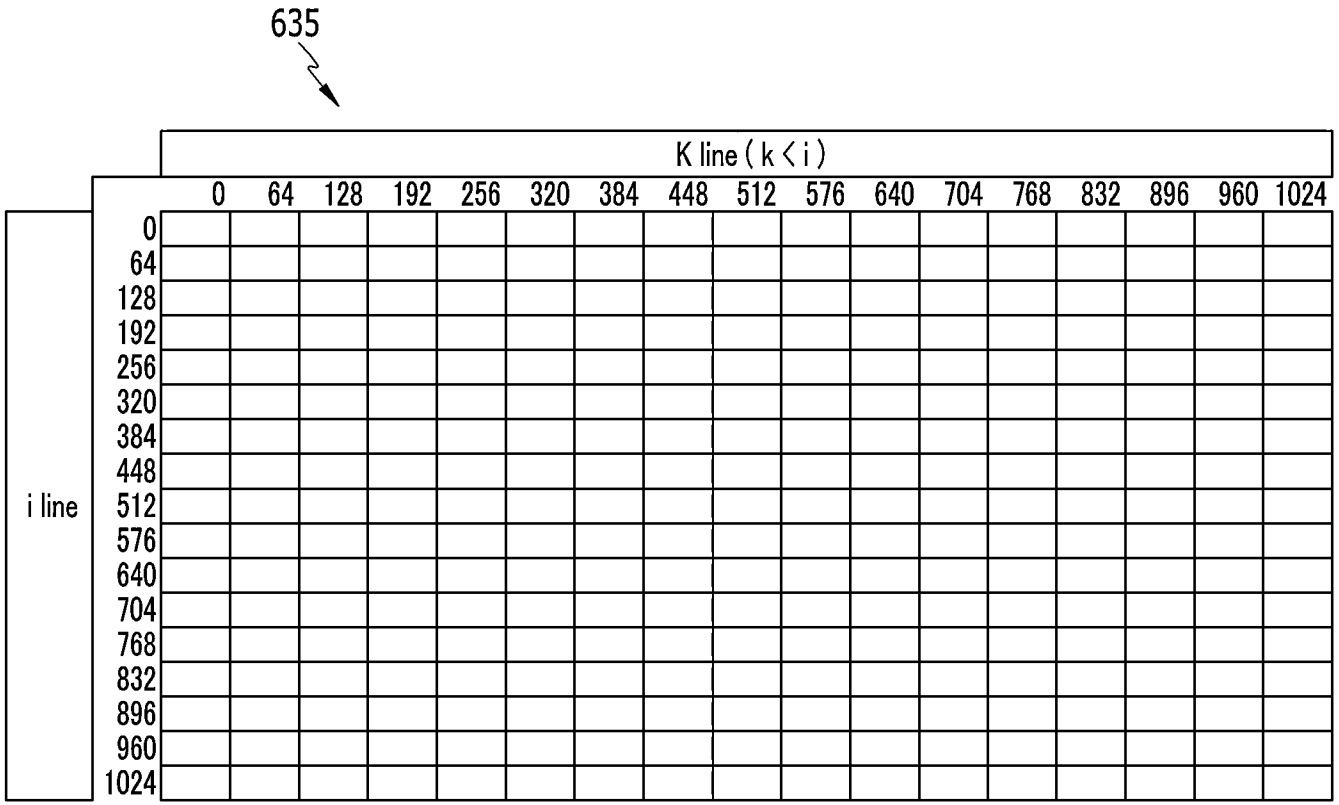
FIG. 18 is a diagram showing an example of a second lookup table included in the signal adjusting unit of the display device according to an exemplary embodiment.

FIG. 18 is a diagram showing an example of a second lookup table included in the signal adjusting unit of the display device according to an exemplary embodiment.

Referring to FIG. 2, the display device according to an exemplary embodiment may further include an image signal realigner 620, a second adjuster 630, and a vertical boundary detector 640, in addition to the first adjuster 610.

The vertical boundary detector 640 determines whether a pixel is positioned in the vicinity of the boundary region BR of the image pattern based on the input image signal IDAT. For example, in a display device according to an exemplary embodiment, in the case in which a pixel PX is pre-charged when a pixel previous to the pixel PX is mainly charged, the vertical boundary detector 640 may determine that the pixel PX is in the vicinity of the boundary region BR of the image pattern when the pixel PX is positioned one row, two rows, or three rows below the boundary region BR. Or the detector 640 may determine that the pixel PX is not in the vicinity of the boundary region BR. The vertical boundary detector 640 can generate a determination result as a flag signal FLAG_E and can send the flag signal to the second adjuster 630.

The image signal realigner 620 receives the adjusted image signal IDAT1 from the first adjuster 610, and realigns the adjusted image signal IDAT based on the position of the pixels PX and the switching devices of the display panel 300. The image signal realigner 620 then generates a realigned image signal IDAT1.

In the case in which the display device according to an exemplary embodiment has the structure shown in FIG. 14 described above, the image signal realigner 620 may determine whether a sub-pixel of a pixel PX, which is an adjustment target, is a first sub-pixel PXa or a second sub-pixel PXb. The image signal realigner 620 can then determine whether a sub-pixel having an effect on pre-charging of the pixel PX is a first sub-pixel PXa or a second sub-pixel PXb, and generate a determination result as a flag signal FLAG_D, and send the flag signal to the second adjuster 630.

The image signal realigner 620 transfers the realigned image signal IDAT1 and the flag signal FLAG_D to the second adjuster 630.

The second adjuster 630 may include a second lookup table 635.

Referring to FIG. 18, the second lookup table 635 is connected to the i-th gate line Gi, is connected to some or all of the grayscales of the adjusted image signal IDAT1 of the pre-charged pixel PX or sub-pixel PXa or PXb and the k-th gate line Gk, and stores adjusted values for some or all of the grayscales of the adjusted image signal IDAT1 of the pixel PX or the sub-pixel PXa or PXb having an effect on the pre-charging.

The k-th gate line Gk referenced by the second lookup table 635 is positioned in a row previous to the i-th gate line Gi, and may also include a plurality of gate lines. In the case in which the second lookup table 635 references a plurality of pixels PX having an effect on the pre-charging in addition to the pixel PX, it may include a plurality of lookup tables.

The display device according to an exemplary embodiment may be driven such that one data line transfers data voltages Vd for the pixels PX representing different primary colors as shown in FIG. 7. The display device may be driven such that one data line transfers data voltages Vd for different sub-pixels PXa and PXb as shown in FIG. 9 or FIG. 14. When the display device is driven depending on the driving waveform shown in FIG. 11, the k-th gate line Gk referenced by the second lookup table 635 may be an (i−2)-th gate line G(i−2).

In the case in which the display device according to an exemplary embodiment is driven using the driving waveform shown in FIG. 12 or FIG. 13, the second lookup table 635 may also include an (i−1)-th gate line G(i−1), an (i−2)-th gate line G(i−2), and an (i−3)-th gate line G(i−3).

The display device according to an exemplary embodiment may be driven such that one data line transfers data voltages Vd for the pixels PX representing the same primary color as shown in FIG. 8. When the display device is driven using the driving waveform shown in FIG. 11, the k-th gate line Gk referenced by the second lookup table 635 may be an (i−1)-th gate line G(i−1).

In the case in which a width of the pre-charging period P is longer than 1H as in an exemplary embodiment shown in FIG. 12 or FIG. 13, the k-th gate line Gk referenced by the second lookup table 635 may include a plurality of gate lines such as an (i−1)-th gate line G(i−1), an (i−2)-th gate line G(i−2), and an (i−3)-th gate line G(i−3). The case in which the k-th gate line Gk referenced by the second lookup table 635 shown in FIG. 18 includes the plurality of gate lines, as described above, corresponds to the case in which the pre-charging period P of the pixel PX overlaps with the main-charging period M of a plurality of rows of pixels PX previous to the pixel PX.

In this case, the signal controller 600 according to an exemplary embodiment may further include a line memory 70 storing the adjusted image signals IDAT1 or the realigned image signals IDAT1' of the plurality of pixels PX having an effect on the pre-charging.

In the case in which the pixel PX according to an exemplary embodiment is divided into two sub-pixels PXa and PXb as shown in FIG. 14, the second lookup table 635 may include lookup tables of a number corresponding to that of the pairs of first sub-pixels PXa or second sub-pixels PXb that are pre-charged and first sub-pixels PXa or second sub-pixels PXb having an effect on the pre-charging. In this case, the respective lookup tables may store different adjusted values. In this case, the second adjuster 630 may select the lookup tables depending on the flag signal FLAG_D from the image signal realigner 620.

Since the first and second sub-pixels PXa and PXb generally have different areas and different charging rates, different adjusted values are stored depending on whether the pre-charged sub-pixels having an effect on the pre-charging are the first sub-pixel PXa or the second sub-pixel PXb, thereby making it possible to further increase display quality of the image.

In an exemplary embodiment shown in FIG. 14, since the sub-pixel having an effect on the pre-charging is the first sub-pixel PXa when the pre-charged sub-pixel is the first sub-pixel PXa and the sub-pixel having an effect on the pre-charging is the second sub-pixel PXb when the pre-charged sub-pixel is the second sub-pixel PXb, the second lookup table 635 may include two lookup tables for each case.

The adjusted values stored by the second lookup table 635 may be set to adjusted values allowing a boundary in the column direction, that is, the vertical direction, of the image pattern to be clear.

For example, in the case in which the pre-charged pixel PX is the pixel connected to the i-th gate line Gi in an exemplary embodiment shown in FIG. 16, the pixel PX having an effect on the pre-charging is the pixel PX connected to the (i−2)-th gate line G(i−2). Adjusted values of the second lookup table 635 corresponding to the image signals IDAT1 of these two pixels PX may be a negative value such that they may further decrease grayscales of the adjusted signals IDAT1 of the pixels PX.

In the case in which it is determined based on the flag signal FLAG_E that the corresponding pixel PX is in the vicinity of a boundary region BR of the image pattern, the second adjuster 630 adjusts the adjusted image signal IDAT1 with reference to the second lookup table 635 to generate a secondarily adjusted image signal IDAT2. In the case in which it is determined based on the flag signal FLAG_E that the pixel PX is not in the vicinity of the boundary region BR of the image pattern, the second adjuster 630 does not adjust the adjusted image signal IDAT1, but may output the adjusted image signal IDAT1 itself as an adjusted image signal IDAT2.

In the case in which it is determined that the pixel PX is in the vicinity of the boundary region BR, the second adjuster 630 finds an adjusted image signal IDAT1 of the pixel PX or sub-pixel PXa or PXb and an adjusted image signal IDAT1 of the pixel or the sub-pixel PXa or PXb having an effect on the pre-charging of the corresponding pixel PX or sub-pixel PXa or PXb using the flag signal FLAG_D. The second adjuster 630 then finds an adjusted value with reference to the second lookup table 635 using the found adjusted image signals IDAT1. The adjusted value found from the second lookup table 635 may be added to the adjusted image signal IDAT1 and then be output as the adjusted image signal IDAT2.

Therefore, blurring in the boundary boundary region BR of the image pattern may be prevented.

What is claimed is:

1. A display device comprising:

a display panel including a plurality of pixels, a plurality of gate lines arranged in a column direction, and a plurality of data lines intersecting the plurality of gate lines;

a data driver configured to transfer data voltages to the plurality of data lines;

a gate driver configured to transfer gate signals to the plurality of gate lines; and a signal controller configured to control the data driver and the gate driver, wherein the signal controller includes:

a vertical boundary detector configured to detect whether a first pixel among the plurality of pixels is positioned in the vicinity of a boundary of an image pattern based on an input image signal for the first pixel, wherein a gray level for a pixel in a row above the boundary is different from a gray level for a pixel in a row below the boundary; and a first adjuster configured to adjust an image signal of the first pixel and output an adjusted image signal when the vertical boundary detector detects that the first pixel is positioned in the vicinity of the boundary of the image pattern, wherein the first adjuster adjusts the image signal of the first pixel based on an image signal of at least one second pixel each positioned in a row prior to the first pixel and the image signal of the first pixel, wherein the at least one second pixel is configured to be charged with a data voltage of a first data line to which the first pixel is connected before the first pixel is charged.

2. The display device of claim 1, wherein the first adjuster includes a first lookup table configured to store a first adjusted value corresponding to the image signal of the first pixel and the image signal of the second pixel.

3. The display device of claim 2, wherein the gate signal includes a pre-charging period and a main-charging period during which a gate-on voltage is applied to the pixels, wherein the pre-charging period for the first pixel overlaps with the main-charging period for the second pixel, and wherein the second pixel is positioned prior to the first pixel by k rows, wherein k is a natural number.

4. The display device of claim 3, wherein the vertical boundary detector is configured to determine that the first pixel is positioned m rows below a boundary of the image pattern, wherein m is a natural number of k or less.

5. The display device of claim 4, wherein the signal controller further includes an image signal realigner configured to realign image signals of the pixels including the first and second pixels to send the realigned image signals to the first adjuster.

6. The display device of claim 5, wherein the pixel includes first and second sub-pixels displaying an image based on different gamma curves, and wherein the first lookup table includes a plurality of lookup tables configured to store the first adjusted values corresponding to an image signal for the first or second sub-pixel included in the first pixel and an image signal of the first or second sub-pixel included in the second pixel.

7. The display device of claim 6, wherein one data line is alternately connected to the first and second sub-pixels by a unit of a pixel row along a column direction.

8. The display device of claim 5, wherein the signal controller further includes a second adjuster configured to adjust the input image signal for the first pixel to generate the image signals for the plurality of pixels and to send the generated image signals to the image signal realigner.

9. The display device of claim 8, wherein the second adjuster includes a plurality of second lookup tables each corresponding to different positions of the display panel, wherein the second lookup table is configured to store a second adjusted value of the input image signal for the first pixel, the second adjusted value being a value that depends on the input image signal for the first pixel and an input image signal for the second pixel, and wherein the signal controller is configured to adjust the input image signal for the first pixel using the second adjusted value.

10. The display device of claim 9, wherein the plurality of second lookup tables include different lookup tables depending on a distance from the data driver.

11. The display device of claim 10, wherein the plurality of second lookup tables include different lookup tables depending on a distance from the gate driver.

12. The display device of claim 4, wherein the at least one second pixel includes a pixel among the plurality of pixels positioned in a pixel row.

13. The display device of claim 4, wherein the at least one second pixel includes a two or more pixels among the plurality of pixels positioned in different pixel rows from each other.

14. The display device of claim 13, wherein the pre-charging period and the main-charging period are consecutive to each other.

15. A driving method of a display device including a display panel including a plurality of pixels, a plurality of gate lines arranged in a column direction, and a plurality of data lines intersecting the plurality of gate lines, a data driver connected to the plurality of data lines, a gate driver connected to the plurality of gate lines, and a signal controller controlling the data driver and the gate driver, the method comprising:

determining whether a first pixel among the plurality of pixels is positioned in the vicinity of a boundary of an image pattern based on an input image signal for the first pixel, wherein a gray level for a pixel in a row above the boundary is different from a gray level for a pixel in a row below the boundary; and adjusting an image signal of the first pixel and outputting an adjusted image signal of the first pixel based on an image signal of a at least one second pixel each positioned in a row prior to the first pixel and the image signal of the first pixel when the first pixel is determined to be in the vicinity of the boundary of the image pattern, wherein the at least one second pixel is configured to be charged with a data voltage of a first data line to which the first pixel is connected before the first pixel is charged.

16. The driving method of a display device of claim 15, wherein in the adjusting of the image signal of the first pixel to output the adjusted image signal, a first lookup table storing a first adjusted value corresponding to the image signal of the first pixel and the image signal of the second pixel is referenced.

17. The driving method of a display device of claim 16, wherein the gate signal includes a pre-charging period and a main-charging period in which a gate-on voltage is applied to pixels, wherein the pre-charging period for the first pixel overlaps with the main-charging period for the second pixel, and wherein the second pixel is positioned prior to the first pixel by k rows, wherein k is a natural number.

18. The driving method of a display device of claim 17, further comprising determining whether the first pixel is positioned m rows below a boundary of the image pattern, wherein m is a natural number of k or less.

19. The driving method of a display device of claim 18, further comprising realigning image signals of the plurality of pixels including the first and second pixels before the adjusting of the image signal of the first pixel to output the adjusted image signal.

20. The driving method of a display device of claim 19, further comprising adjusting the input image signal for the first pixel to generate the image signals for the plurality of pixels before the realigning of the image signals of the plurality of pixels including the first and second pixels.

* * * * *